United States Patent [19]

Sakanoue et al.

[11] Patent Number: 4,812,389

[45] Date of Patent: Mar. 14, 1989

[54] PROCESS FOR PROCESSING SILVER HALIDE COLOR PHOTOGRAPHIC MATERIAL CONTAINING DIR COUPLER HAVING A GROUP FUNCTIONING AS A DEVELOPMENT INHIBITOR

[75] Inventors: Kei Sakanoue; Seiji Ichijima; Shinzo Kishimoto, all of Minami Ashigara, Japan

[73] Assignee: Fuji Photo Film Co., Ltd., Kanagawa, Japan

[21] Appl. No.: 911,619

[22] Filed: Sep. 25, 1986

[30] Foreign Application Priority Data

Sep. 25, 1985 [JP] Japan ..... 60-211498
Dec. 9, 1985 [JP] Japan ..... 60-276620

[51] Int. Cl.[4] ..... G03C 1/46; G03C 5/24; G03C 5/44

[52] U.S. Cl. ..... 430/382; 430/430; 430/443; 430/471; 430/472; 430/473; 430/474; 430/475; 430/476; 430/505; 430/957

[58] Field of Search ..... 430/957, 382, 430, 443, 430/471, 472, 473, 474, 475, 476, 505

[56] References Cited

U.S. PATENT DOCUMENTS

| | | | |
|---|---|---|---|
| 3,189,452 | 6/1965 | Bard et al. | 430/393 |
| 3,617,283 | 11/1971 | Ohi et al. | 430/427 |
| 3,773,510 | 11/1973 | Fisch | 430/393 |
| 3,809,563 | 5/1974 | Nimura | 430/393 |
| 3,893,858 | 7/1975 | Wabnitz, Jr. | 430/393 |
| 4,040,837 | 8/1977 | Sakamoto et al. | 430/379 |
| 4,144,068 | 3/1979 | Ishibashi et al. | 430/393 |
| 4,477,563 | 10/1984 | Ichijima et al. | 430/544 |
| 4,552,834 | 11/1985 | Lau et al. | 430/393 |

FOREIGN PATENT DOCUMENTS 926569 5/1963 United Kingdom .

OTHER PUBLICATIONS

Heinz Mecici & Recycling of Color Paper Developer–J. of App. Phot. Eng. vol. 5, No. 4, 1979 pp. 216–219.

M. Tashiro, Application of Electrodialysis to Developer Reuse in Mech. Proces.–J. of App. Phot. Eng. 5 208–215, 1979.

M. R. V. Sahyun–J. of Appl. Phot. Eng. 5 32–35, (1979), same aspect of Diffusion transfer Chemistry.

*Primary Examiner*—Mukund J. Shah

*Attorney, Agent, or Firm*—Sughrue, Mion, Zinn, Macpeak & Seas

[57] ABSTRACT

A process for processing a DIR coupler-containing silver halide color photographic material for photographing use in a continuous manner with replenishment of a developer is disclosed in which said DIR coupler is a coupler which has in a coupling site a group that functions as a development inhibitor or a development inhibitor precursor upon being eliminated from the coupling active site by color development processing and that will be decomposed to a compound exerting substantially no influences on photographic properties after flowing into a color developing solution, said development inhibitor having a half-value period of 4 hours or shorter than that at a pH of 10.0, and in which the developing solution is replenished in an amount of 700 ml or less per $m^2$ of developed light-sensitive materials.

16 Claims, No Drawings

PROCESS FOR PROCESSING SILVER HALIDE COLOR PHOTOGRAPHIC MATERIAL CONTAINING DIR COUPLER HAVING A GROUP FUNCTIONING AS A DEVELOPMENT INHIBITOR

FIELD OF THE INVENTION

The present invention relates to a process for processing silver halide photographic materials for photographing use and, more particularly, to a process for processing photographic materials which enables reduction in the amount of replenishing developer.

In addition, it pertains to a novel light-sensitive material and a process for processing it, which enables shortening of the time of the silver-removing step.

BACKGROUND OF THE INVENTION

In general, color photographic images can be formed by color-developing an imagewise exposed light-sensitive material in a color developer containing an aromatic primary amine developing agent such as p-phenylenediamine, then subjecting it to the processing of bleaching, fixing, washing with water, and stabilizing. A bleach-fixing processing is also known, in which bleaching and fixing are conducted at the same time for accelerating the ordinary processing.

In recent years, it has been regarded important to keep the environment clean, and to save and recover water and silver in automatic processing color photographic materials in a continuous manner, and method for preventing environmental pollution, methods for effectively recovery silver, methods for reducing the amount of washing water, methods for re-using washing water, and the like have been eagerly demanded.

In view of simplifying photographic processing, too, it has been strongly desired to reduce the amount of replenishing developer in a replenishing type development processing step.

In continuous development processing, the replenishing amount of a developer used somewhat varies depending upon the kind of light-sensitive materials to be processed, but is usually about 1300 to 1100 ml per $m^2$ of processed silver halide color photographic materials for photographing use.

From the above-described standpoint, it has been desired to reduce the amount of replenishing developer. However, reduction in amount of replenishing developer leads to deterioration of photographic properties, and hence it is generally extremely difficult.

On the other hand, in order to fill the demand for maintaining a clean environment, various processes have been tried for reproducing color developer in color development processing steps.

For example, there are illustrated those described in J. Appl. Phot. Eng., 5, 208 (1979), Gekkan Labo, 15, 113 (1979), SMPTE, J., 88, 165 (1979), J. Appl. Phot. Eng., 5, 32 (1979), SMPTE, J. 88, 168 (1979), Japanese Patent Application (OPI) Nos. 143018/77, 1462336/77, 149331/78, 9629/79, J. Appl. Phot. Eng., 5, 216 (1979), etc.

In general, reduction in the amount of replenishing developer results in a relative increase in the amount of substance dissolved into the developer from silver halide photographic materials (for example, halide ions produced by decomposition of silver halide), causing the problem of reduction in sensitivity.

As a countermeasure for this problem of reduction in sensitivity, it has been attempted to raise the processing temperature to reduce the amount of replenishing developer without reduction in sensitivity. For example, there is a color paper-processing agent made by Hunt Co. (processing agent CP-LR) (specially described in Photographic Bulletin, No. 49 (published by Hunt Co.), p. 6, in the item of "Color Print Chemistries"), and processes are described in "Preliminary Text for the Meeting of the Photographic Society of Japan, A-7", "Reduction in the amount of replenisher in color paper processing" (1980), etc. Additionally, the former processing agent enables reduction in the amount of replenishing color developer ½ to ⅔.

However, since these are agents for processing color papers, they cannot be applied as such to color photographic materials for photographing use in view of the problems with respect to photographic properties such as sensitivity, gradation, color reproduction, etc.

In processing color negative-working films, the aforesaid processing agent made by Hunt Co. (described in *Photographic Bulletin,* No. 55 published by Hunt Co.) has a formulation of replenishing in an amount as low as 754 ml per $m^2$. However, it is still insufficient with respect to processing stability.

This may be attributed to the fact that, as a problem peculiar to color photographic materials for photographing use, a development inhibitor released after a coupling reaction from a DIR (development inhibitor-releasing) type coupler which is often used for improving interlayer effect and sharpness dissolves into and accumulates in the developer.

It is, therefore, a primary object of the present invention to provide a process for processing silver halide color photographic materials for photographing use without causing the problem with photographic properties such as desensitization in the case of reducing the amount of replenishing developer.

On the other hand, fundamental steps of color light-sensitive materials are generally a developing step and a silver-removing step. In the color-developing step, exposed silver halide is reduced with a color-developing agent to produce silver and, at the same time, the oxidized color-developing agent in turn reacts with a color former (coupler) to give a dye image. In the subsequent silver-removing step, silver having been produced in the color-developing step is oxidized by the action of an oxidant (called bleaching agent), then dissolved with a silver ion-chelating agent usually called a fixing agent. After this silver-removing step, only a dye image is formed in the color light-sensitive material.

The above-described silver-removing step is conducted in two manners: one being conducted using two baths of a bleaching agent-containing bleaching bath and a fixing agent-containing bath; and the other being conducted using a mono-bath of a bleach-fixing bath containing both a bleaching agent and a fixing agent.

In addition to the above-described fundamental steps, actual development processing involves various auxiliary steps such as a hardening bath, a stopping bath, an image-stabilizing bath, a water-washing bath, etc., for the purpose of keeping the photographic and physical quality of the image, or for impoving preservability of the image.

In general, red prussiate, dichromates, ferric chloride, ferric aminopolycarboxylate complex salts, persulfates, etc., are known as the bleaching agents.

However, red prussiate and dichromates involve the environmental pollution problem with respect to cyan compounds and hexavalent chromium, and require special processing equipment. Ferric chloride involves the problem of production of ferric hydroxide in the subsequent water-washing step and the problem of forming stains, thus involving various difficulties in practical use. Persulfates have the defect that they possess such a weak bleaching effect that they require a seriously long bleaching time. As to this defect, it has been proposed to enhance the bleaching effect by using together a bleaching accelerator. However, persulfates themselves are regulated by the law of the prevention and extinction of fire which provides persulfates and dangerous substances, and require various measures for storage, thus being generally difficult to use.

Ferric aminopolycarboxylate complex salts (particularly ferric ethylenediaminetetraacetate complex salts or ferric diethylenetriaminepentaacetate complex salts) are at present most widely used as bleaching agents since they cause less environmental problems and can be stored with no trouble which is different from persulfates. However, the bleaching power of the ferric aminopolycarboxylate complex salts is not necessarily sufficient. When they are used as bleaching agents, the desired purpose can be attained to some extent in the case of bleaching or bleach-fixing low speed silver halide color light-sensitive materials primarily containing a silver chlorobromide emulsion, but there results insufficient removal of silver, or a long bleaching time is required in the case of bleaching or bleach-fixing high speed color-sensitized color light-sensitized materials primarily containing a silver chlorobromoiodide or silver bromoiodide emulsion, particularly color reversal light-sensitive materials and color negative light-sensitive materials for photographing using high silver content emulsions.

For example, in bleach-fixing color negative-working light-sensitive materials for photographing use using a bleaching solution containing ferric aminopolycarboxylate complex salt, bleaching must be conducted for at least four minutes and, in order to keep the bleaching powder, complicated control such as control of pH of the bleaching solution and controlled aeration are required. In fact, such control still often fails to prevent bleaching failure.

Further, in order to remove silver, a processing using a fixing solution for at least 3 minutes is required subsequent to the bleaching processing. It has been eagerly desired to shorten the long time required for the silver-removing processing.

On the other hand, as a means for accelerating the silver-removing step, a bleach-fixing solution containing a ferric aminopolycarboxylate complex salt and a thiosulfate as described in German Pat. No. 866,605 is known. However, when allowed to be copresent with the thiosulfate having a reducing power, the ferric aminopolycarboxylate originally having a weak oxidizing (bleaching) powder undergoes such a serious reduction of bleaching power that it is extremely difficult to fully remove silver from a high-speed, high-silver content color light-sensitive material for photographing use, thus such means cannot be put into practice. Of course, various attempts have so far been made to remove the above-described effects of the bleach-fixing solution. For example, there is a technique of adding an iodide or bromide as described in British Pat. No. 926,569 and Japanese Patent Publication No. 11854/78 and a technique of incorporating a ferric aminopolycarboxylate complex salt in a high concentration with the aid of triethanolamine as described in Japanese Patent Application (OPI) Nos. 192953/82 and 95834/73 (the term "OPI" as used herein means an "unexamined published patent application") and U.S. Pat. No. 4,552,834. However, these techniques provide still insufficient effects, and cannot be practically employed with sufficient effects.

In addition to the problem of insufficient silver-removing power, the bleach-fixing solution involves a serious problem of spoiling color reproduction by reducing a cyan dye once formed by the color developement to a leuco dye. This problem is known to be solved by raising the pH of the bleach-fixing solution as is described in U.S. Pat. No. 3,773,510. However, a raised pH further weakens the bleaching power, and thus cannot be employed. U.S. Pat. No. 3,189,452 discloses a process of oxidizing, after the processing in the bleach-fixing solution, the leuco dye to the former cyan dye by using a bleaching solution containing red prussiate. However, the use of red prussiate involves the problem of environmental pollution as has been described hereinbefore and, even when bleaching is further conducted after the bleach-fixing processing, the amount of remaining silver is scarcely decreased.

As another technique for raising the bleaching power of ferric aminopolycarboxylate complex salt, it has been proposed to add various bleaching accelerators to a bleaching bath, a bleach-fixing bath, or a pre-bath thereof.

As the bleaching accelerators, there are illustrated, for example, various mercapto compounds as described in U.S. Pat. No. 3,893,858, British Pat. No. 1,138,842, and Japanese Patent Application (OPI) No. 141623/78, disulfide bond-containing compounds described in Japanese Patent Application (OPI) No. 98630/78, thiazolidine derivatives as described in Japanese Patent Publication No. 9854/78, isothiourea derivatives as described in Japanese Patent Application (OPI) No. 94927/78, thiourea derivatives as described in Japanese Patent Publication Nos. 8506/70 and 26586/74, thioamide compounds as described in Japanese Patent Application (OPI) No. 42349/74, dithiocarbamic acid salts as described in Japanese Patent Application (OPI) No. 26506/80, etc.

Some of these accelerators show a bleaching-acclerating effect to some extent, but the effect is not necessarily sufficient. Thus, they fail to meet the requirement for shortening the processing time.

SUMMARY OF THE INVENTION

As a result of intensive investigations for attaining the above-described objects, the inventors have found that it is important to control the hydrolysis rate of a development inhibitor released and dissolved from a DIR coupler into a color developer, thus having completed the present invention.

(1) A process for processing a DIR coupler-containing silver halide color photographic material for photographing use in a continuous manner with replenishment of a developer, in which said DIR coupler is a coupler which has in a coupling active site a group that functions as a development inhibitor or a precursor thereof upon being eliminated from the coupling active site by color development processing and that will be decomposed to a compound exerting substantially no influence on photographic properties after flowing into a color developer, said development inhibitor having a half-value period of 4 hours or shorter at a pH of 10.0, and in which process the developer is replenished in an amount of 700 ml or less per $m^2$ of light-sensitive materials developed.

(2) A process for processing a DIR coupler-containing silver halide color photographic material for photographing use in a continuous manner with replenishment of a developer, in which said DIR coupler is a coupler which has in a coupling active site a group that functions as a development inhibitor or a precursor thereof upon being eliminated from the coupling active site by color development processing and that will be decomposed to a compound exerting substantially no influences on photographic properties after flowing into a color developer, said development inhibitor having a half-value period of 4 hours or shorter at a pH of 10.0, and which process is conducted in the presence of a compound or compounds represented by the following general formula (I) and/or (II):

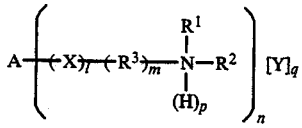

(I)

In the above general formula (I), A represents an n-valent aliphatic, aromatic or heterocyclic linking group (provided that when n=1, A represents a mere aliphatic, aromatic or heterocyclic group).

As the aliphatic linking group represented by A, there are illustrated alkylene groups containing 3 to 12 carbon atoms (e.g., a trimethylene group, a hexamethylene group, a cyclohexylene group, etc.).

As the aromatic linking group, there are illustrated 5- or 6-membered arylene groups containing 6 to 18 carbon atoms (e.g., a phenylene group, a naphthylene group, etc.).

As the heterocyclic linking group, there are illustrated heterocyclic groups containing one or more hetero atoms (e.g., a thienyl group, a furyl group, a thiazinyl group, a pyridyl group, a piperidyl group, etc.).

Usually, one aliphatic, aromatic or heterocyclic group is present, but two or more of them may be linked to each other directly or through a divalent linking group (e.g.,

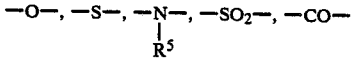

or a linking group formed by these linking groups, with $R^5$ representing a lower alkyl group having 1 to 10 carbon atoms).

These aliphatic, aromatic, and heterocyclic groups may have substituents. Examples of such substituents include an alkoxy group having 1 to 10 carbon atoms, a halogen atoms, an alkyl group having 1 to 10 carbon atoms, a hydroxyl group, a carboxy group, a sulfo group, a sulfonamido group, a sulfamoyl group, etc. X represents

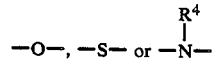

(wherein $R^4$ represents a lower alkyl group having 1 to 6 carbon atoms such as a methyl group, an ethyl group, etc.).

$R^1$ and $R^2$ each represents a substituted or unsubstituted lower alkyl group having 1 to 6 carbon atoms (e.g., a methyl group, an ethyl group, a propyl group, an isopropyl group, a pentyl group, etc.). As the substituents thereof, a hydroxy group, a lower alkoxy group having 1 to 6 carbon atoms (e.g., a methoxy group, a methoxyethoxy group, a hydroxyethoxy group, etc.), an amino group (e.g., an unsubstituted amino group, a dimethylamino group, an N-hydroxyethyl-N-methylamino group, etc.) are preferable. Where two or more substituents exist, they may be the same or different.

$R^3$ represents a lower alkylene group containing 1 to 5 carbon atoms (e.g., a methylene group, an ethylene group, a trimethylene group, a methylmethylene group, etc.).

Y represents an anion (a halide ion such as chloride ion or bromide ion, a nitrate ion, a sulfate ion, a p-toluenesulfonate ion, an oxalate ion, etc.).

$R^1$ and $R^2$ may be taken together through a carbon atom or a hetero atom (e.g., an oxygen atom, a nitrogen atom, a sulfur atom, etc.) to form a 5- or 6-membered hetero ring (e.g., a pyrrolidine ring, a piperidine ring, a morpholine ring, a triazine ring, an imidazoline ring, etc.).

$R^1$ (or $R^2$) and A may be taken together through a carbon atom or a hetero atom (e.g., an oxygen atom, a nitrogen atom, a sulfur atom, etc.) to form a 5- or 6-membered hetero ring (e.g., a hydroxyquionline ring, a hydroxyindole ring, an isoindoline ring, etc.). Further, $R^1$ (or $R^2$) and $R^3$ may be taken together through a carbon atom or a hetero atom (e.g., an oxygen atom, a nitrogen atom, a sulfur atom, etc.) to form a 5- or 6-membered hetero ring (e.g., a piperidine ring, a pyrrolidine ring, a morpholine ring, etc.).

l represents 0 or 1, m represents 0 or 1, n represents 1, 2 or 3, p represents 0 or 1, and q represents 0, 1, 2 or 3.

Specific compounds within the scope of the present invention are illustrated below which, however, do not limit the present invention in any way.

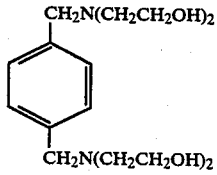

(1)

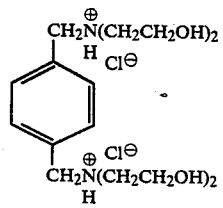

(2)

-continued
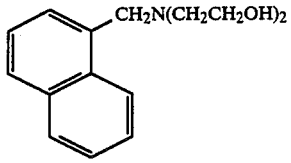
(3)
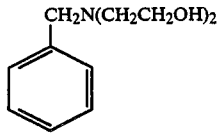
(4)
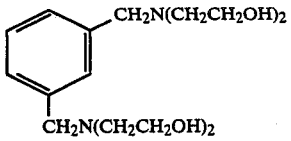
(5)
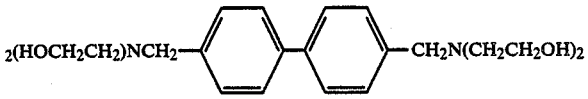
(6)
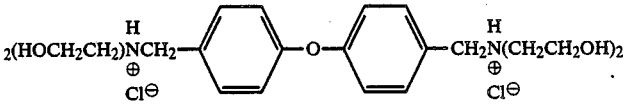
(7)
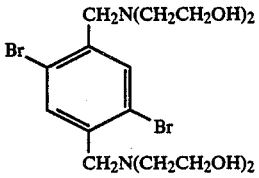
(8)
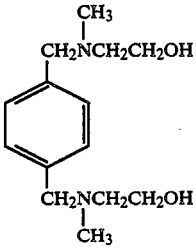
(9)
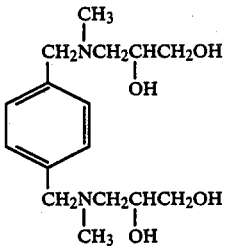
(10)
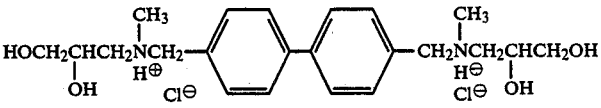
(11)
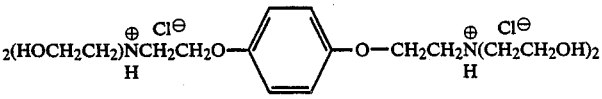
(12)
(13)
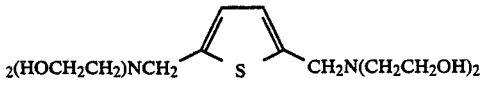
(14)
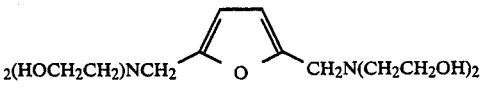

-continued (15)

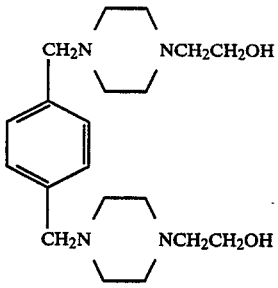

(16)

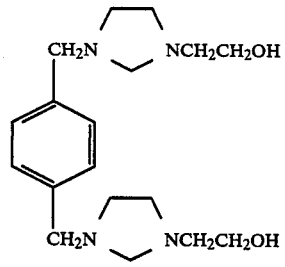

(17)

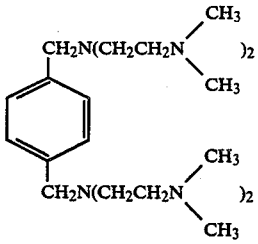

(18)

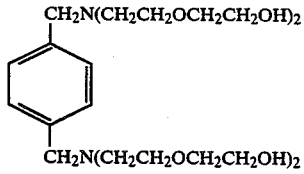

(19)

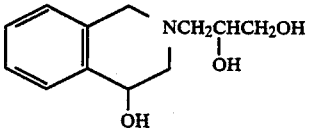

(20)

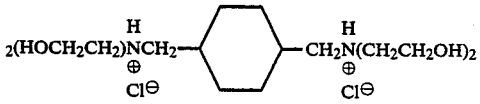

(21)

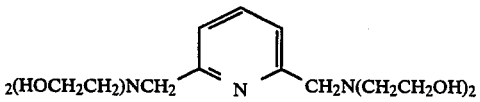

(22)

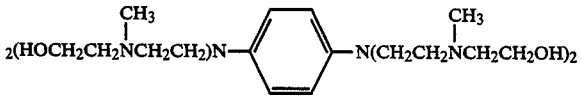

(23)

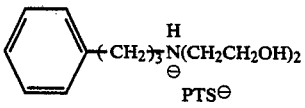

(24)

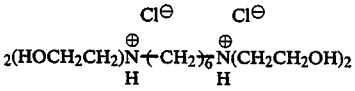

Compounds of the general formula (I) can be synthesized by the well known processes described in the following literature: U.S. Pat. No. 4,552,834, Japanese Patent Publication No. 12056/79, and Japanese Patent Application (OPI) No. 192953/82.

(II)

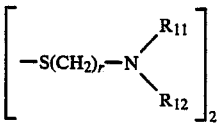

In the above general formula (II), $R_{11}$ and $R_{12}$, which may be the same or different, each represents a hydrogen atom, a substituted or unsubstituted lower alkyl group (preferably containing 1 to 5 carbon atoms; particularly a methyl group, an ethyl group or a propyl group) or an acyl group containing preferably 1 to 3 carbon atoms (e.g., an acetyl group, a propionyl group, etc.), and r represents an integer of 1 to 3.

$R_{11}$ and $R_{12}$ may be taken together through a carbon atom or a hetero atom (e.g., an oxygen atom, a nitrogen atom, a sulfur atom, etc.) to form a 5- or 6-membered hetero ring (e.g., a piperidine ring, a pyrrolidine ring, a morpholine ring, etc.).

As $R_{11}$ and $R_{12}$, substituted or unsubstituted lower alkyl groups are particularly preferable.

Examples of the substituents $R_{11}$ and $R_{12}$ include a hydroxyl group, a carboxy group, a sulfo group, an amino group, etc.

Specific examples of the compounds represented by the general formula (II) are illustrated below which, however, do not limit the present invention in any way.

[II]-(1)

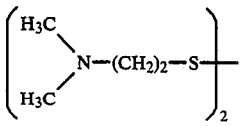

-continued

[II]-(2)

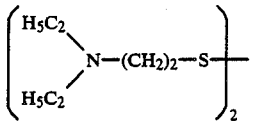

[II]-(3)

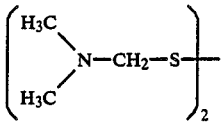

[II]-(4)

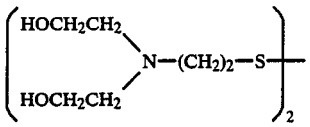

[II]-(5)

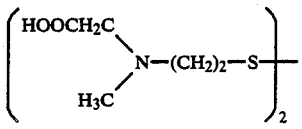

[II]-(6)

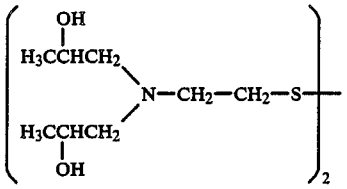

[II]-(7)

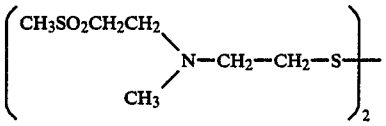

[II]-(8)

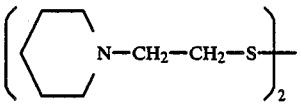

[II]-(9)

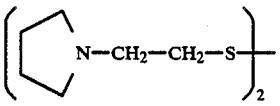

[II]-(10)

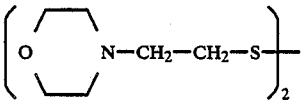

Compounds of the general formula (II) can be synthesized by the method described in Japanese Patent Application (OPI) No. 95630/78.

(3) A process for processing a DIR coupler-containing silver halide color photographic material for photographing use in a continuous manner with replenishment of a developer, in which said DIR coupler is a coupler which has in a coupling active site a group that functions as a development inhibitor or a precursor thereof upon eliminated from the coupling active site by color development processing and that will be decomposed of a compound exerting substantially no influences on photographic properties after flowing into a color developer, said development inhibitor having a half-value period of 4 hours or shorter at a pH of 10.0, and in which process the light-sensitive material is processed, after the color development, in a bleaching solution having a pH of 5.7 or less.

(4) The process for processing a silver halide photographic material as described in (2) above, wherein the photographic material is processes, in a silver-removing step, in a bath having a bleach-fixing ability or in a bleaching bath and a subsequent bath having a bleach-fixing ability.

(5) The process for processig a silver halide photographic material as described in (2) above, wherein a bleaching bath having a pH of 5.7 or less is provided in a silver-removing step.

(6) The process for processing a silver halide photographic material as described in (1) above, which is conducted in the presence of at least one of the compounds represented by the general formula (I) and/or (II) as described above.

(7) The process for preparing a silver halide photographic material as described in (6) above, wherein said photographic material is processed, in the silver-removing step, in a bath having a bleach-fixing ability or in a bleaching bath and a subsequent bath having a bleach-fixing ability.

(8) The process for processing a silver halide photographic material as described in (7) above, wherein said bleaching solution has a pH of 5.7 or less.

The objects of the present invention can be attained by the above-described processes.

DETAILED DESCRIPTION OF THE INVENTION

With the recent increase in demand for high quality of light-sensitive materials, DIR couplers have become more important, and the amounts thereof to be added to light-sensitive materials have been increases.

On the other hand, the detrimental influence of development inhibitors releases from DIR couplers has been overlooked as a cause of deteriorating silver-removing properties accompanying shortening of the processing time.

The inventors have found that development inhibitors released from DIR couplers are the main cause of deterioration of silver-removing properties encountered when silver-removing steps are shortened.

As a result of further investigation, the inventors have found that silver-removing properties can be greatly improved by using a silver removal-accelerating agent together with the DIR coupler and decreasing the pH of the bleaching solution, thus having completed the present invention.

The present invention enables attainment of the objects of reducing the amount of reducing the amount of replenishing developer and shortening the time for the silver-removing steps, which have been required for photographic processing.

The DIR couplers to be used in the present invention are couplers which have, in a coupling-active site, a group that comes a development-inhibiting compound (a development inhibitor or a precursor thereof) when released from the active site of the coupler by color development reaction and that will be decomposed, after flowing into a color developer, to a compound which exerts substantially no photographic influences. In addition, the development inhibitor must have a definite decomposition rate constant. That is, the development inhibitor must have a half-value period of not longer than 4 hours, preferably not longer than 2 hours, more preferably not longer than 1 hour.

The half-value period of the development inhibitor or a precursor thereof is measured according to the following method. That is, a sample development inhibitor is added to a developer of the following formulation in a concentration of $1\times10^{-4}$ mol/liter and, after keeping the solution at 38° C., the concentration of the remaining development inhibitor is measured by liquid chromatography.

Diethylenetriaminepentaacetic acid 0.8 g
1-Hydroxyethylidene-1,1-diphosphonic acid 3.3 g
Sodium sulfite 4.0 g
Potassium carbonate 30.0 g
Potassium bromide 1.4 g
Potassium iodide 1.3 mg
Hydroxylamine sulfate 2.4 g
4-(N-Ethyl-N-β-hydroxyethylamino)-2-methylaniline sulfate 4.5 g
Water to make 1 liter
pH 10.0

The half-value period greatly varies depending upon pH of the developer used. therefore, the amount of remaining development inhibitor can be controlled by controlling the pH of a developer upon development processing.

The equilibrium concentration (x) of the development inhibitor in a running state in the case of using the DIR coupler having the above-described hydrolysis elimination group can be represented by the following differential equation:

$$dx=[a-(v+kV)x]dt$$

k: decomposition rate constant
V: volume of developing tank
a: amount of dissolved development inhibitor
v: replenishing amount
t: time To solve this equation, let $dx/dt=0$, $X=a/(v+kV)$. Thus, equilibrium concentration of the development inhibitor, x, depends upon the amount of dissolved development inhibitor, a, and the decomposition rate constant, k.

As the hydrolysis type DIR couplers to be used in the present invention, any of those which have a half-value period of the above-described length may be used. More particularly, there are illustrated hydrolysis type DIR couplers represented by the following general formula (I'):

$$A\text{-}[(L_1)_a\text{—}Z\text{—}(L_2\text{—}Y)_b]_m$$

wherein:

A represents a coupler component;

Z represents a fundamental portion of a compound which shows development-inhibiting action, and is bound to the coupling site of a coupler directly (a—0) or through a linking group, $L_1$ (a=1);

Y represents a substituent bond to Z through a linking group $L_2$ to allow the development-inhibiting effect of Z to emerge, with the linking group represented by $L_2$ containing a chemical bond to be cleaved in a developer;

a represents 0 or 1, and b represents 1 or 2, provided that when b represents 2, two (—$L_2$—Y)s may be the same or different; and m represents 1 or 2.

After coupling with an oxidation product of a color developing agent, the compounds represented by the general formula (I) release $^{\theta}Z$—($L_2$—Y) or $^{\theta}L_1$—Z—($L_2$—Y). The later immediately undergoes cleavage of $L_1$, to become $^{\theta}Z$—($L_2$—Y). $^{\theta}Z$—($L_2$—Y) diffuses through the light-sensitive layer showing a development-inhibiting effect and partly enters into the development processing solution. $^{\theta}Z$—($L_2$—Y) having entered into the processing solution is rapidly decomposed at a chemical bond contained in $L_2$. That is, linking between Z and Y is cleaved, and a compound wherein a water-soluble group is bound to Z having a small development-inhibiting ability remains in the developer. Thus, the development-inhibiting effect substantially disappears.

Eventually, the development-inhibiting compound does not accumulate in the processing solution, and hence the processing solution can be repeatedly used and a sufficient amount of DIR coupler can be incorporated in light-sensitive materials.

As the yellow color image-forming coupler residue represented by A, pivaloylacetanilide type coupler residues, benzoylacetanilide type coupler residues, malonicdiester type residues, malonicdiamine type residues, dibenzoylmethane type residues, benzothiazolylacetamide type residues, malonic ester monoamide type residues, benzothiazolyl acetate type residues, benzoxazolylacetamide type residues, benzoxazolyl acetate type residues, benzimidazolylacetamide type residues, or benzimidazolyl acetate type coupler residues, coupler residues derived from the hetero ring-substituted acetamides or hetero ring-substituted acetates described in U.S. Pat. No. 3,841,880, coupler residues derived from acylacetamides described in U.S. Pat. No. 3,770,446, British Pat. No. 1,459,171, West German patent application (OLS) No. 2,503,099, Japanese patent application (OPI) No. 139,738/75, or Research Disclosure, No. 15737, and hetero ring type coupler residues described in U.S. Pat. No. 4,046,574 are preferable.

As the magenta color image-forming coupler residues represented by A, coupler residues having a 5-oxo-2-pyrazoline nucleus or a pyrazolo[1,5-a]benzimidazole nucleus, cyanoacetophenone type coupler residues, and couplers containing a pyrazolotriazole nucleus are preferable.

As the cyan color image-forming coupler residues represented by A, phenol nucleus- or alpha-naphthol nucleus-containing coupler residues are preferable.

Further, as this type coupler residues represented by A which show the same effect as DIR couplers though substantially not forming dyes after coupling with an oxidation product of a developing agent to release a development inhibitor, there are illustrated those coupler residues which are described in U.S. Pat. Nos. 4,052,213, 4,088,491, 3,631,345, 3,958,993, or 3,961,959.

As the fundamental portion of the development inhibitor represented by Z, there are illustrated a divalent N-containing heterocyclic group and N-containing heterocyclic thio group. Examples of the heterocyclic thio group include a tetrazolylthio group, a benzothiazolylthio group, a benzimidazolylthio group, a triazolylthio group, an imidazolylthio group, etc. Specific examples thereof are illustrated below with showing the substituting positions of groups A—($L_1$)- and —($L_2$—Y).

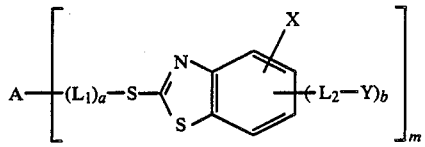

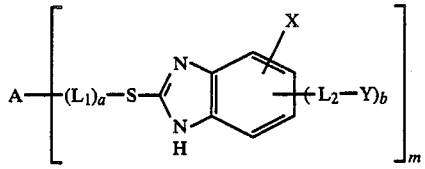

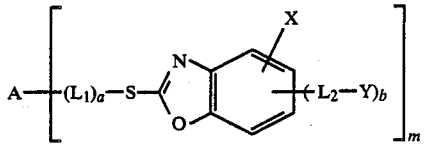

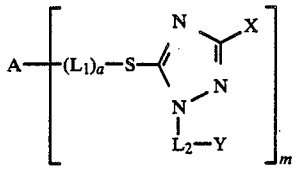

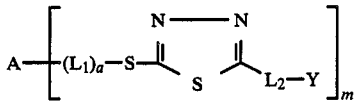

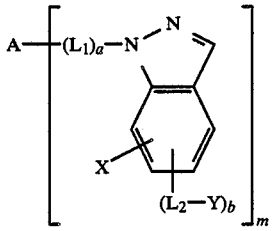

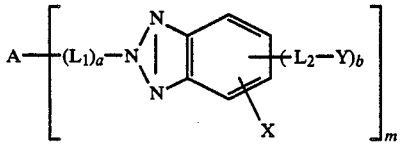

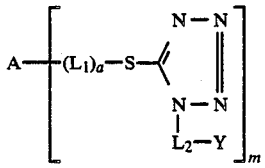

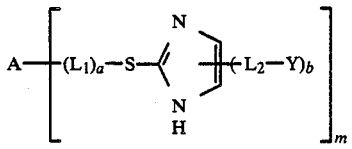

-continued

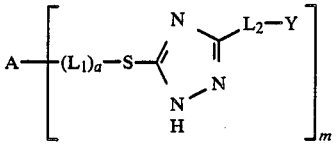

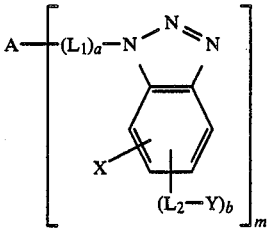

In the above formulae, the substituent represented by X is included in a portion represented by Z in the general formula (I'), and represents a hydrogen atom, a halogen atom, an alkyl group having 1 to 10 carbon atoms (e.g., a methyl group, an ethyl group, a propyl group, an isopropyl group, a pentyl group, etc.), an alkenyl group having 2 to 10 carbon atoms (e.g., a vinyl group, an allyl group, etc.), an alkanamido group having 1 to 10 carbon atoms (e.g., a methanamido group, an ethanamido group, etc.), an alkenamido group having 2 to 10 carbon atoms (e.g., an ethenamido group, etc.), an alkoxy group having 1 to 10 carbon atoms (e.g., a methoxy group, an ethoxy group, a proproxy group, etc.), a sulfonamido group having 1 to 10 carbon atoms (e.g., a methanesulfonamido group, an ethanesulfonamido group, etc.) or an aryl group having 6 to 10 carbon atoms (e.g., a phenyl group, etc.).

Examples of the group represented by Y in the general formula (I') include an alkyl group having 1 to 10 carbon atoms (e.g., a methyl group, an ethyl group, a propyl group, an isopropyl group, a pentyl group, etc.), a cycloalkyl group having 3 to 10 carbon atoms (e.g., a cyclopentyl group, a cyclohexyl group, etc.), an alkenyl group having 2 to 10 carbon atoms (e.g., a vinyl group, an allyl group, etc.), a cycloalkenyl group having 3 to 10 carbon atoms (e.g., a cyclopentenyl group, a cyclohexenyl group, etc.), an aryl group having 6 to 10 carbon atoms (e.g., a phenyl group, etc.), an aralkyl group having 7 to 10 carbon atoms (e.g., a benzyl group, a phenethyl group, etc.), or a 5- or 6-membered heterocyclic group containing an oxygen atom, a nitrogen atom or a sulfur atom as a hetero atom (e.g., a pyridyl group, etc.).

Examples of the linking group represented by $L_1$ in the general formula (I') include those which are shown below together with A and Z—($L_2$—Y).

$$A[-OCH_2-Z-(L_2-Y)_b]_m$$

(linking group described in U.S. Pat. No. 4,146,396).

$$A\text{+}SCH_2-Z-(L_2-Y)_b]_m$$

$$A\text{+}\overset{O}{\overset{\|}{C}}-Z-(L_2-Y)_b]_m$$

(linking group described in West German patent application (OLS) No. 2,626,315).

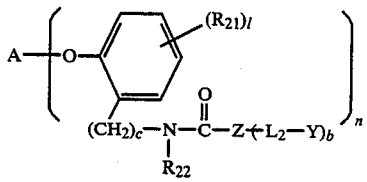

(linking group described in West German patent application (OLS) No. 2,855,697, wherein c represents an integer of 0 to 2).

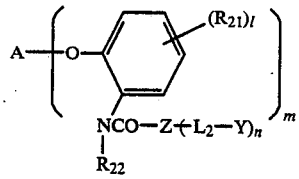

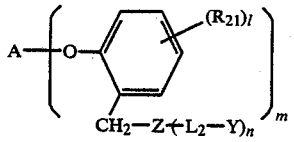

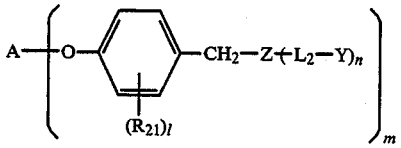

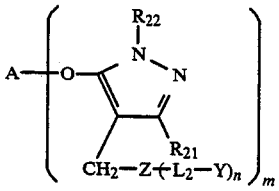

In the above formulae, $R_{21}$ represents a hydrogen atom, a halogen atom, an alkyl group having 1 to 6 carbon atoms (e.g., a methyl group, an ethyl group, a propyl group, an isopropyl group, a pentyl group, etc.), an alkenyl group having 2 to 6 carbon atoms (e.g., a vinyl group, an allyl group, etc.), an aralkyl group having 7 to 10 carbon atoms (e.g., a benzyl group, a phenethyl group, etc.), an alkoxy group having 1 to 6 carbon atoms (e.g., a methoxy group, an ethoxy group, a pentyloxy group, etc.), an alkoxycarbonyl group having 2 to 7 carbon atoms (e.g., a methylcarbonyl group, an ethylcarbonyl group, etc.), an anilino group, an acylamino group having 1 to 6 carbon atoms (e.g., an acetylamino group, etc.), a ureido group having up to 6 carbon atoms (e.g., a ureido group, a methyl ureido group, etc.), a cyano group, a nitro group, a sulfonamido group having up to 6 carbon atoms (e.g., a sulfonamido group, a methanesulfonamide group, an ethanesulfonamido group, etc.), a sulfamoyl group up to 6 carbon atoms (e.g., a sulfamoyl group, a methylsulfamoyl group, etc.), a carbamoyl group having 1 to 6 carbon atoms (e.g., a carbamoyl group, a methylcarbamoyl group, etc.), an aryl group having 6 to 10 carbon atoms (e.g., a phenyl group, etc.), a carboxy group, a sulfo group, a cycloalkyl group having 3 to 6 carbon atoms (e.g., a cyclopentyl group, a cyclohexyl group, etc.), an alkanesulfonyl group having 1 to 6 carbon atoms (e.g., a methanesulfonyl group, etc.), an arylsulfonyl group having 6 to 10 carbon atoms (e.g., a phenylsulfonyl group, etc.) or an acyl group having 1 to 6 carbon atoms (e.g., an acetyl group, etc.), $R_{22}$ represents a hydrogen atom, an alkyl group having 1 to 6 carbon atoms (e.g., a methyl group, an ethyl group, etc.), an alkenyl group having 2 to 7 carbon atoms (e.g., a vinyl group, an allyl group, etc.), an aralkyl group having 7 to 10 carbon atoms (e.g., a benzyl group, a pheneltyl group, etc.), a cycloalkyl group having 3 to 6 carbon atoms (e.g., a cyclopentyl group, a cyclohexyl group, etc.) or an aryl group having 6 to 10 carbon atoms (e.g. a phenyl group), and n and l each represents 1 or 2 and, when l represents 2, $R_{22}$'s may be bound to each other to form a fused ring.

With these DIR couplers (a=1 in the general formula (I')), the coupling-off group to be released after the reaction with an oxidation product of a developing agent is immediately decomposed to release a development inhibitor, H—Z—($L_2$—Y)$_b$. Therefore, they show the same effect as DIR couplers not having the group represented by $L_1$ (a=0 in the general formula (I')).

The linking group represented by $L_2$ in the general formula (I') contains a chemical bond to be cleaved in a developer. Such chemical bond includes those illustrated in the following table. These are cleaved with a nucleophilic reagent such as a hydroxy ion or hydroxylamine used as an ingredient of a color developer, thus providing the effect of the present invention.

| Chemical Bond Contained in $L_2$ | Cleavage Reaction of the Bond Shown on the Left Column |
|---|---|
| —COO— | —COOH— + HO— |
| H<br>—NCOO— | —$NH_2$ + HO— |
| —$SO_2$O—<br>—O$CH_2CH_2SO_2$— | —$SO_2$H + HO—<br>—OH + $CH_2$=$CHSO_4$ |
| —OCO—<br>‖<br>O | —OH + HO— |
| —NHCCO—<br>‖ ‖<br>OO | —$NH_2$ + HO— |

The divalent linking group shown in the above table is linked to Z directly or through an alkylene group having 1 to 6 carbon atoms (e.g., an ethylene group) and/or a phenylene group, whereas it is linked directly to Y. In the case of the divalent linking group being linked to Z through an alkylene group or a phenylene group, the divalent alkylene or phenylene group may contain an ether bond, an amido bond, a carbonyl bond, a thioether bond, a sulfon group, a sulfonamido bond, and a urea bond.

Preferable examples of the linking group represented by $L_2$ include the following groups shown together with the substitution positions of Z and Y.

$-Z-(CH_2)_d COO-Y$ $-Z-(CH_2)_d OC(=O)-Y$

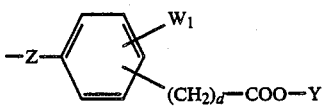

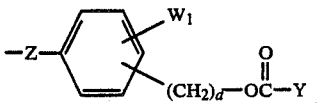

$-Z-(CH_2)_d-NHCOO-Y$ $-Z-(CH_2)_d-OC(=O)NH-Y$ $-Z-NHC(=O)-(CH_2)_d CO-Y$

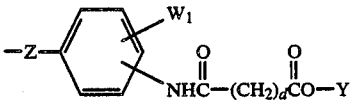

$-Z\leftarrow CH_2\rightarrow_p COOCH_2CH_2SO_2-Y$

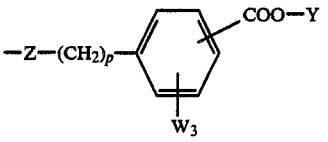

$-Z-NCOO-Y$ ($W_2$)

$-Z-N-COCO-Y$ ($W_2$)

In the above formulae, d represents an integer of 0 to 10, preferably 0 to 5, $W_1$ is selected from among a hydrogen atom, a halogen atom, dan alkyl group containing 1 to 10, preferably 1 to 5, carbon atoms, an alkanamido group containing 1 to 10, preferably 1 to 5, carbon atoms, an alkoxy group containing 1 to 10, preferably 1 to 5, carbon atoms, an alkoxycarbonyl group containing 2 to 10, preferably 2 to 5, carbon atoms, an aryloxycarbonyl group, an alkanesulfonamido group containing 7 to 10 carbon atoms, an aryl group containing 6 to 10 carbon atoms, a carbamoyl group, an N-alkylcarbamoyl group containing 1 to 10, preferably 1 to 5, carbon atoms, a nitro group, a cyano group, an arylsulfonamido group containing 6 to 10 carbon atoms, a sulfamoyl group, an imido group, etc. Specific examples of the groups represented by $W_1$ include an ethyl group, etc. $W_2$ represents a hydrogen atom, an alkyl group containing 1 to 6 carbon atoms, an aryl group containing 6 to 10 carbon atoms or an alkenyl group containing 2 to 10, preferably 2 to 5 carbon atoms. Specific examples of the groups represented by $W_2$ include an isopropyl group. $W_3$, represents a hydrogen atom, a halogen atom, a nitro group, an alkoxy group containing 1 to 6 carbon atoms, or an alkyl group containing 1 to 6 carbon atoms. Specific examples of the groups represented by $W_3$ include a chlorine atom, a methoxy group, etc., and p represents an integer of 0 to 6.

The alkyl or alkenyl group represented by X and Y is specifically a straight, branched or cyclic alkyl or alkenyl group containing 1 to 10, preferably 1 to 5, carbon atoms (e.g., a methyl group, an ethyl group, a propenyl group, etc.) preferably having a substituent or substituents. The substituents are selected from among a halogen atom, a nitro group, an alkoxy group containing 1 to 4 carbon atoms, an aryloxy group containing 6 to 10 carbon atoms, an alkanesulfonyl group containing 1 to 4 carbon atoms, an arylsulfonyl group containing 6 to 10 carbon atoms, an alkanamido group containing 1 to 5 carbon atoms, an anilino group, a benzamido group, an alkyl-substituted carbamoyl group containing 1 to 6 carbon atoms, a carbamoyl group, an aryl-substituted carbamoyl group containing 6 to 10 carbon atoms, an alkylsulfonamido group containing 1 to 4 carbon atoms, an arylsulfonamido group containing 6 to 10 carbon atoms, an alkylthio group containing 1 to 4 carbon atoms, an arylthio group containing 6 to 10 carbon atoms, a phthalimido group, a succinimido group, an imidazolyl group, a 1,2,4-triazolyl group, a pyrazolyl group, a benzotriazolyl group, a furyl group, a benzothiazolyl group, an alkylamino group containing 1 to 4 carbon atoms, an alkanoyl group containing 1 to 4 carbon atoms, a benzoyl group, an alkanoyloxy group containing 1 to 4 carbon atoms, a benzoyloxy group, a perfluoroalkyl group containing 1 to 4 carbon atoms, a cyano group, a tetrazolyl group, a hydroxy group, a carboxyl group, a mercapto group, a sulfo group, an amino group, an alkylsulfamoyl group containing 1 to 4 carbon atoms, an arylsulfamoyl group containing 6 to 10 carbon atoms, a morpholino group, an aryl group containing 6 to 10 carbon atoms, a pyrrolidinyl group, a ureido group, an urethane group, an alkoxy-substituted carbonyl group containing 1 to 6 carbon atoms, an aryloxy-substituted carbonyl group containing 6 to 10 carbon atoms, an imidazolidinyl group, an alkylideneamino group containing 1 to 6 carbon atoms, etc. Specific examples of the substituent include a chlorine atom, a methoxy group, a methylsulfonyl group, a phenylsulfonyl group, a methanamido group, an isopropylcarbamoyl group, etc.

The alkanamido or alkenamido group represented by X is specifically a straight, branched or cyclic alkanamido or alkenamido group containing 1 to 10, preferably 1 to 5, carbon atoms which may optionally have a substituent or substituents. The substituents are selected, for example, from those illustrated above with respect to the alkyl and alkenyl groups. Specific examples of the alkanamido or alkenamido group represented by X include a methanamido group, a propenamido group, etc.

The alkoxy group represented by X is specifically a straight, branched or cyclic alkoxy group containing 1 to 10, preferably 1 to 5, carbon atoms which may optionally have a substituent or substituents. The substituents are selected, for example, from those illustrated above with respect to the alkyl and alkenyl groups. Specific examples of the alkoxy group represented by X include an ethoxy group.

The aryl group represented by Y is specifically a phenyl group or a naphthyl group which may optionally be substituted. The substituents are selected from those illustrated above with respect to the alkyl and alkenyl groups, an alkyl group containing 1 to 4 carbon atoms (e.g., a methyl group, an ethyl group, etc.), and the like.

The heterocyclic group represented by Y is selected from among a diazolyl group (e.g., a 2-imidazolyl group, a 4-pyrazolyl group, etc.), a triazolyl group (e.g., a 1,2,4-triazol-3-yl group, etc.), a thiazolyl group (e.g., a 2-benzothiazolyl group, etc.), an oxazolyl group (e.g., a 1,3-oxazol-2-yl group, etc.), a pyrrolyl group, a pyridyl group, a diazinyl group (e.g., a 1,4-diazin-2-yl group, etc.), a triazinyl group (e.g., a 1,2,4-triazin-5-yl group, etc.), a furyl group, a diazolinyl group (e.g, an imidazolin-2-yl group, etc.), a pyrrolinyl group, a thienyl group, etc.

Of the couplers represented by the general formula (I'), those represented by the following general formulae (II'), (III'), (IV'), (V'), (VI'), (VII') and (VIII') are useful. These couplers release a development inhibitor having a strong development-inhibiting effect, thus being preferable.

General formula (II')

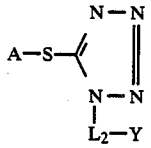

General formula (III')

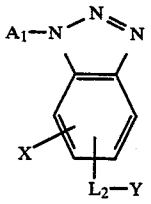

General formula (IV')

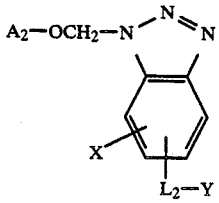

General formula (V')

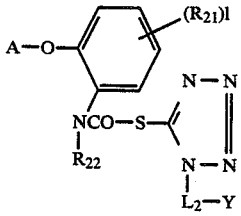

General formula (VI')

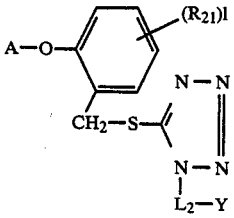

-continued

General formula (VII')

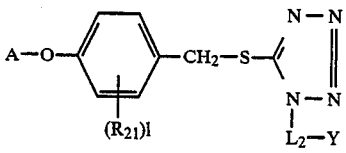

General formula (VIII')

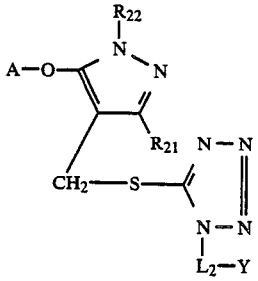

A, $L_2$, $R_{21}$, $R_{22}$, and Y in the general formulae (II') and (V') to (VIII') are the same as defined with respect to the general formula (I').

$A_1$ in the general formula (III') represents a coupler residue having been described for A in the general formula (I') other than a cyan coupler residue.

$A_2$ in the general formula (IV') represents a cyan coupler residue among those described for A in the general formula (I').

X, $L_2$, $R_{21}$, $R_{22}$ and Y are the same as defined above with respect to the general formula (I').

Couplers represented by the following general formulae (IX'), (X'), (XI'), (XII'), (XIII'), (XIV') and (XV') exhibit particularly high effects. These couplers show a high coupling-off rate, thus being preferable.

General formula (IX')

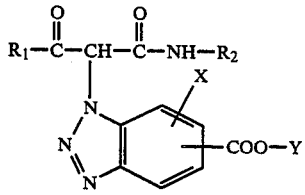

General formula (X')

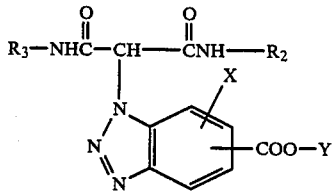

General formula (XI')

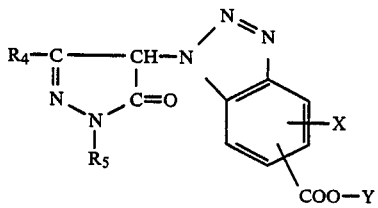

-continued
General formula (XII')
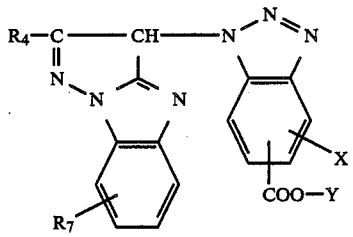
General formula (XIV')
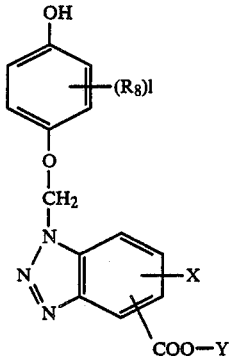
General formula (XIII')
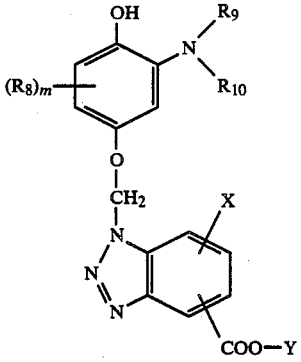
General formula (XV')
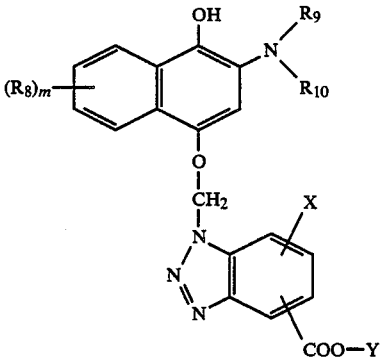
-continued
General formula (XVI)
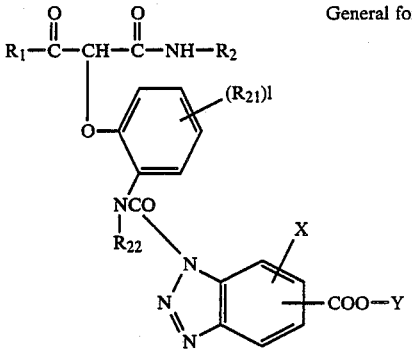
General formula (XVII)
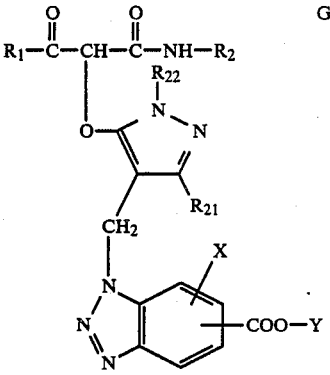
General formula (XVIII)
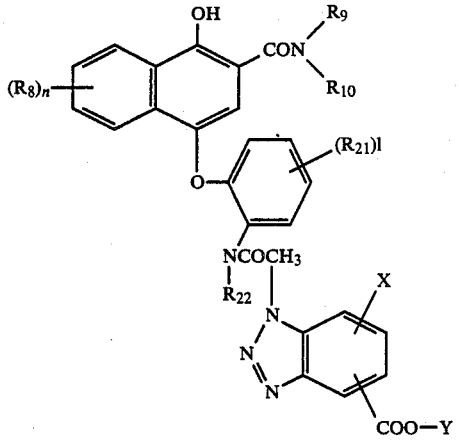
General formula (XIX)
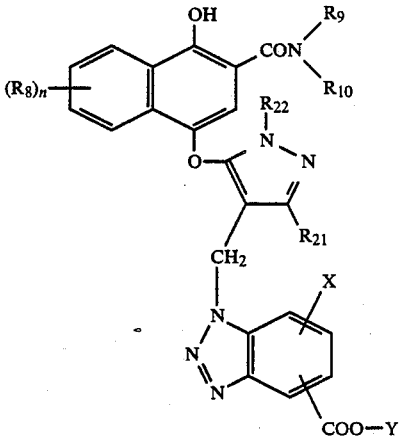

In the above general formulae, $R_{21}$, $R_{22}$, X and Y are the same as defined above with respect to the general formulae (II) and (III).

In the above general formulae, $R_1$ represents an aliphatic group, an aromatic group, an alkoxy group or a heterocyclic group, $R_2$ and $R_3$ each represents an aromatic group or a 5- or 6-membered heterocyclic group containing an oxygen atom, a nitrogen atom or a sulfur atom as a hetero atom.

The aliphatic group represented by $R_1$ preferably contains 1 to 22 carbon atoms, and may be substituted or unsubstituted, chain-like or cyclic. Preferable substituents for the alkyl group include an alkoxy group (e.g., an ethoxy group, etc.), an aryloxy group (e.g., a phenoxy group, etc.), an amino group, an acylamino group (e.g., an acetylamino group, etc.), a halogen atom (e.g., a chlorine atom, etc.), etc., which themselves may further have a substituent or substituents. Specific examples of the aliphatic group useful as $R_1$ are: an isopropyl group, an isobutyl group, a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an alpha-aminoisopropyl group, an alpha-(diethylamino)isopropyl group, an alpha-(succinimido)isopropyl group, an alpha(phthalimido)isopropyl group, an alpha-(benzensulfonamido)isopropyl group, etc.

Where $R_1$, $R_2$ or $R_3$ represents an aromatic group (particularly a phenyl group), the aromatic group may optionally be substituted. That is, the aromatic group such as a phenyl group may be substituted by an alkyl group, an alkenyl group, an alkoxy group, an alkoxycarbonyl group, an alkoxycarbonylamino group, an aliphatic amido group, an alkylsulfamoyl group, an alkylsulfonamido group, an alkylureido group, an alkyl-substituted succinimido group, etc. containing up to 32 carbon atoms. The alkyl group may be interrupted by a phenylene group or the like in the chain. Further, the phenyl group may be substituted by an aryloxy group, an aryloxycarbonyl group, an arylcarbamoyl group, an arylamido group, an arylsulfamoyl group, an arylsulfonamido group, an arylureido group, etc. The aryl moiety of these substituents may further be substituted by one or more alkyl groups containing 1 to 22 carbon atoms (e.g., an ethyl group, an isopropyl group, etc.).

The phenyl group represented by $R_1$, $R_2$ or $R_3$ may further be substituted by an amino group including those substituted by an alkyl group containing 1 to 6 carbon atoms (e.g., a methyl group, an ethyl group, etc.), a hydroxy group, a carboxy group, a sulfo group, a nitro group, a cyano group, a thiocyano group, or a halogen atom (e.g., a chlorine atom, a bromine atom, etc.).

$R_1$, $R_2$ or $R_3$ may represent a substituent wherein a phenyl group is fused with another ring, such as a naphthyl group, a quinolyl group, an isoquinolyl group, a chromanyl group, a coumaranyl group, a tetrahydronaphthyl group, etc. These substituents themselves may further have a substituent or substituents.

Where $R_1$ represents an alkoxy group or an alkenyloxy group, the alkyl or alkenyl moiety thereof represents a straight or branched alkyl or alkenyl group having 1 to 40, preferably 1 to 22, carbon atoms, or a cyclic alkyl or alkenyl group, which may be substituted by a halogen atom, an aryl group, an alkoxy group, etc.

Where $R_1$, $R_2$ or $R_3$ represents a heterocyclic group, the heterocyclic group is bound to the carbon atom of the carbonyl group of the acyl group in the alpha-acylacetamide or to the nitrogen atom of the amido group through one of the carbon atoms forming the ring. Examples of the heterocyclic group include thiophene, furan, pyran, pyrrole, pyrazole, pyridine, pyrazine, pyrimidine, pyridazine, indolidine, imidazole, thiazole, oxazole, triazine, thiadiazine, oxazine, etc. These may further have a substituent or substituents on the ring.

Suitable examples of the groups represented by $R_1$ include a 4-methoxybenzoyl group, a t-butyl group, etc. Suitable examples of the groups represented by $R_2$ or $R_3$ include a 2-chlorophenyl group, a 5-amido-substituted phenyl group, etc.

In the general formula (XI), $R_5$ represents a straight or branched alkyl group containing 1 to 40, preferably 1 to 22, carbon atoms (e.g., a methyl group, an isopropyl group, a tert-butyl group, a hexyl group, a dodecyl group, etc.), an alkenyl group having 2 to 40, preferably 2 to 22, carbon atoms (e.g., an allyl group, etc.), a cyclic alkyl group having 5 to 40, preferably 5 to 22, carbon atoms (e.g., a cyclopentyl group, a cyclohexyl group, a norbornyl group, etc.), an aralkyl group having 7 to 40, preferably 7 to 22, carbon atoms (e.g., a benzyl group, $\beta$-phenylethyl group, etc.), a cyclic alkenyl group having 5 to 40, preferably 5 to 22, carbon atoms (e.g., a cyclopentenyl group or a cyclohexenyl group, etc.). These may be substituted by a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group, a mercapto group, etc.

Further, $R_5$ may represent an aryl group having 6 to 40 carbon atoms (e.g., a phenyl group, an $\alpha$- or $\beta$-naphthyl group, etc.). The aryl group may have one or more substituents such as an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group, a mercapto group, etc. More preferable as $R_5$ are phenyl groups substituted with an alkyl group, an alkoxy group, a halogen atom, etc., in at least one o-position. They are useful since couplers remaining in a film membrane undergo less fading by light or heat.

Further, $R_5$ may represent a heterocyclic group (e.g., a 5- or 6-membered heterocyclic or fused heterocyclic group containing a nitrogen atom, an oxygen atom or a sulfur atom as a hetero atom; e.g., a pyridyl group, a quinolyl group, a furyl group, a benzothiazolyl group, an oxazolyl group, an imidazolyl group, a naphthoxazolyl group, etc.), a heterocyclic group substituted with a substituent or substituents having been referred to with the above aryl group, an aliphatic or aromatic acyl group, an alkylsulfonyl group, an arylsulfonyl group, an alkylcarbamoyl group, an arylcarbamoyl group, an alkylthiocarbamoyl group or an arylthiocarbamoyl group.

$R_4$ contains up to 40, preferably up to 22, carbon atoms and represents a hydrogen atom, a straight or branched alkyl or alkenyl group, a cyclic alkyl group, an aralkyl group, a cyclic alkenyl group (these groups may have a substituent or substituents having been referred to for $R_5$), an aryl group and a heterocyclic group (these groups may have a substituent or substituents having been referred to for $R_5$), an alkoxycarbonyl group (e.g., a methoxycarbonyl group, an ethoxycarbonyl group, a stearyloxycarbonyl group, etc.), an aryloxycarbonyl group (e.g., a phenoxycarbonyl group, a naphthoxycarbonyl group, etc.), an aralkyloxycarbonyl group (e.g., a benzyloxycarbonyl group, etc.), an alkoxy group (e.g., a methoxy group, an ethoxy group, a heptadecyloxy group, etc.), an aryloxy group (e.g., a phenoxy group, a tolyloxy group, etc.), an alkylthio group (e.g., an ethylthio group, a dodecylthio group, etc.), an arylthio group (e.g., a phenylthio group, an alpha-naphthylthio group, etc.), a carboxy group, an acylamino group (e.g., an acetylamino group, a 3-[(2,4-di-tert-amylphenoxy)acetamido]benzamido group, etc.), a diacylamino group, an N-alkylacylamino group (e.g., an N-methylpropionamido group, etc.), an N-arylacylamino group (e.g., an N-phenylacetamido group, etc.), a ureido group (e.g., a ureido group, an N-arylureido group, an N-alkylureido group, etc.), a urethane group, a thiourethane group, an arylamino group (e.g., a phenylamino group, an N-methylanilino group, a diphenylamino group, an N-acetylanilino group, a 2-chloro-5-tetradecanamidoanilino group, etc.), an alkylamino group (e.g., an n-butylamino group, a methylamino group, a cyclohexylamino group, etc.), a cycloamino group (e.g., a piperidino group, a pyrrolidino group, etc.), a heterocyclic amino group (e.g., a 4-pyridylamino group, a 2-benzoxazolylamino group, etc.), an alkylcarbonyl group (e.g., a methylcarbonyl group, etc.), an arylcarbonyl group (e.g., a phenylcarbonyl group, etc.), a sulfonamido group (e.g., an alkylsulfonamido group, an arylsulfonamido group, etc.), a carbamoyl group (e.g., an ethylcarbamoyl group, a dimethylcarbamoyl group, an N-methyl-phenylcarbamoyl group, an N-phenylcarbamoyl group, etc.), a sulfamoyl group (e.g., an N-alkylsulfamoyl group, an N,N-dialkylsulfamoyl group, an N-arylsulfamoyl group, an N-alkyl-N-arylsulfamoyl group, an N,N-diakylsulfamoyl group, an N-arylsulfamoyl group, an N-alkyl-N-arylsulfamoyl group, N,N-diarylsulfamoyl group, etc.), a cyano group, a hydroxy group, a mercapto group, a halogen atom, or a sulfo group.

$R_7$ represents a hydrogen atom or groups which may contain up to 32, preferably up to 22, carbon atoms such as straight or branched chain alkyl or alkenyl group, a cyclic alkyl group, an aralkyl group or a cyclic alkenyl group, which may have a substituent or substituents having been referred to for $R_5$.

$R_7$ may represent an aryl group containing 6 to 22 carbon atoms or a 5- or 6-membered heterocyclic group containing an oxygen atom, a nitrogen atom or a sulfur atom as a hetero atom, which may have a substituent or substituents having been referred to for $R_5$ above.

$R_7$ may represent a cyano group, an alkoxy group, an aryloxy group, a halogen atom, a carboxy group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group or a mercapto group.

$R_8$, $R_9$, and $R_{10}$ each represents a group used in ordinary 4-equivalent phenol or α-napthol couplers. Specifically, $R_8$ represents a hydrogen atom, a halogen atom, an aliphatic hydrocarbon residue, an acylamino group, —O—$R_{23}$ or —S—$R_{23}$ (provided that $R_{23}$ (provided that $R_{11}$ represents an aliphatic hydrocarbon residue) and, where two or more $R_8$'s exist in the same molecule, they may be different from each other. The aliphatic hydrocarbon residue includes those which have a substituent or substituents.

As $R_9$ and $R_{10}$, there are illustrated an aliphatic hydrocarbon residue having 1 to 22 carbon atoms, an aryl group having 6 to 22 carbon atoms, and a 5- or 6-membered heterocyclic residue containing an oxygen atom, a nitrogen atom or a sulfur atom as a hetero atom. One of them may be a hydrogen atom, and they include those which have a substituent or substituents. Further, $R_9$ and $R_{10}$ may be taken together to form a 5- or 6-membered nitro-containing heterocyclic nucleus. l represents an integer of 1 to 4, m represents an integer of 1 to 3, and n an integer of 1 to 5. As the aliphatic hydrocarbon residue, either of saturated and unsaturated ones, and any of straight, branched, and cyclic ones may be used. Preferable examples thereof include an alkyl group (e.g., a methyl group, an ethyl group, a propyl group, an isopropyl group, a butyl group, a t-butyl group, an isobutyl group, a dodecyl group, an octadecyl group, a cyclobutyl group, etc.), and an alkenyl group (e.g., an allyl group, an octenyl group, etc.). As the aryl group, there are illustrated a phenyl group, a naphthyl group, etc., and typical examples of the hetero ring residue include a pyridyl group, a quinolyl group, a thienyl group, a piperidyl group, an imidazolyl group, etc. As the substituents to be introduced into these aliphatic hydrocarbon residues, aryl groups, and heterocyclic residues, there are illustrated groups which may contain up to 22 carbon atoms such as a halogen atom, a nitro group, a hydroxy group, a carboxyl group, an amino group, a substituted amino group, a sulfo group, an alkyl group, an alkenyl group, an aryl group, a hetero ring group, an alkoxy group, an aryloxy group, an arylthio group, an arylazo group, an acylamino group, a carbamoyl group, an ester group, an acyl group, an acyloxy group, an sulfonamido group, a sulfamoyl group, a sulfonyl group, a morpholino group, etc.

Substituents $R_1$, $R_2$, $R_3$, $R_4$, $R_5$, $R_7$, $R_8$, $R_9$, and $R_{10}$ in the couplers represented by the general formulae (IX to (XV) may be taken together, or one of them may be a divalent group, to form a symmetric or assymetric complex coupler.

As the couplers to be used in the present invention, there are illustrated the following couplers which, however, do not limit the present invention in any way.

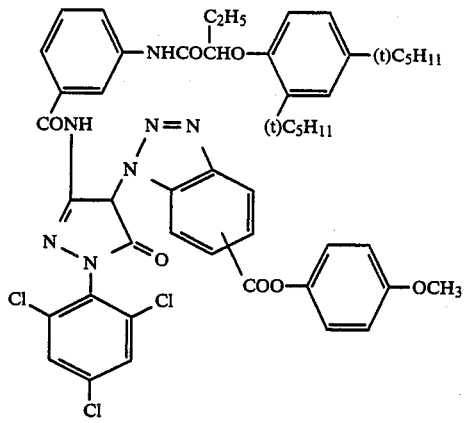
(1)
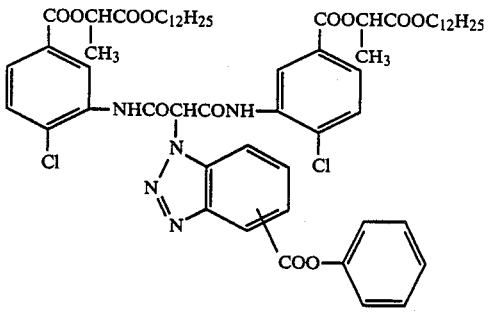
(2)
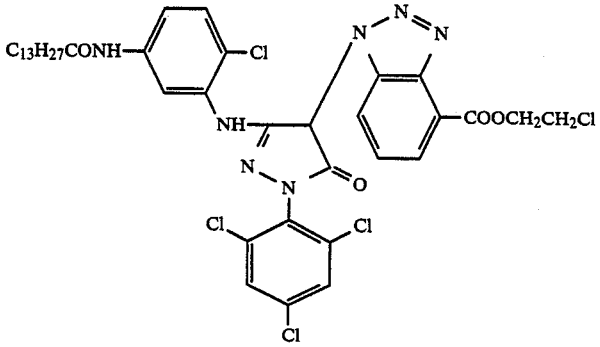
(3)
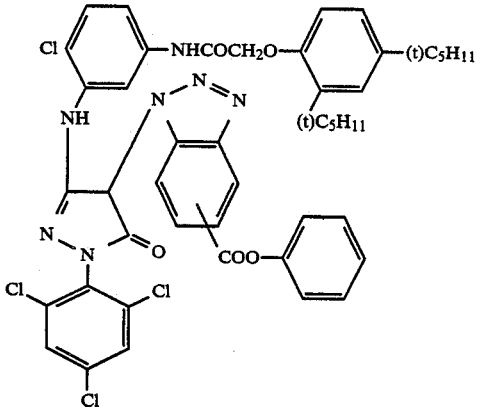
(4)
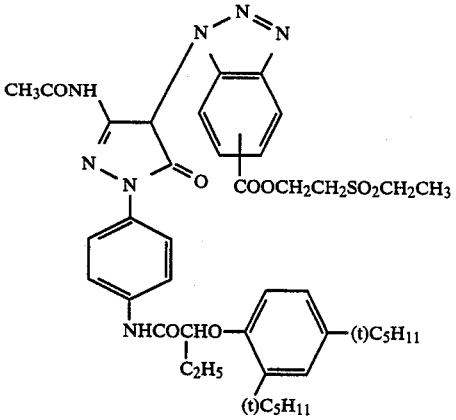
(5)
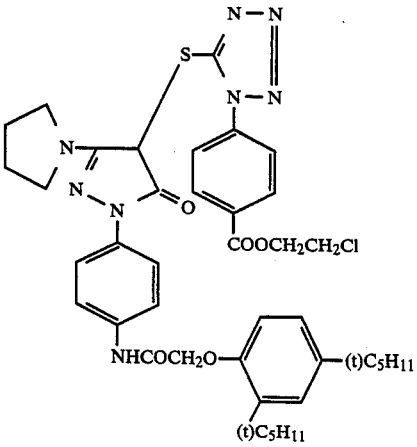
(6)
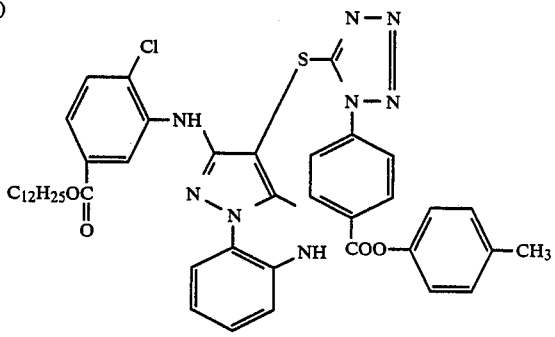
(7)

-continued
(8)
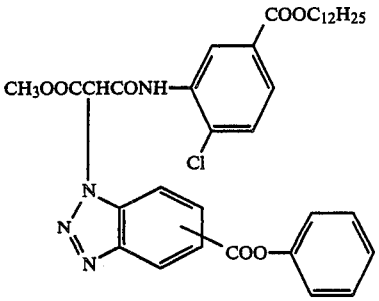
(9)
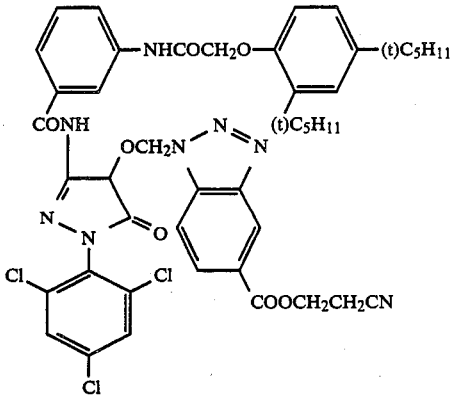
(10)
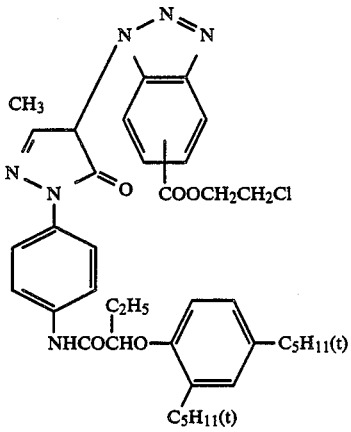
(11)
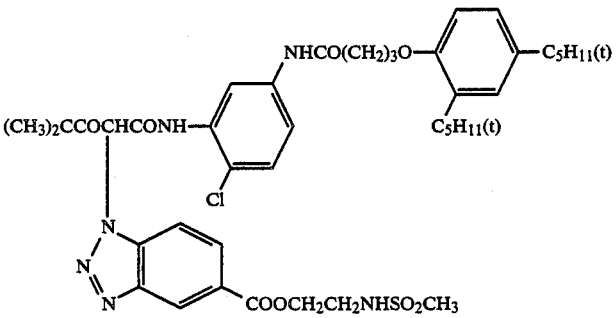
(12)
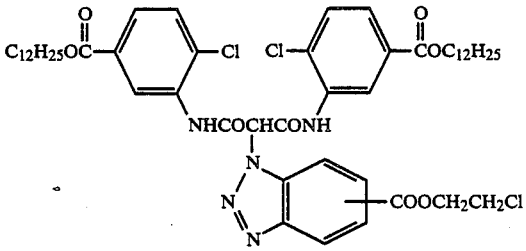
(13)
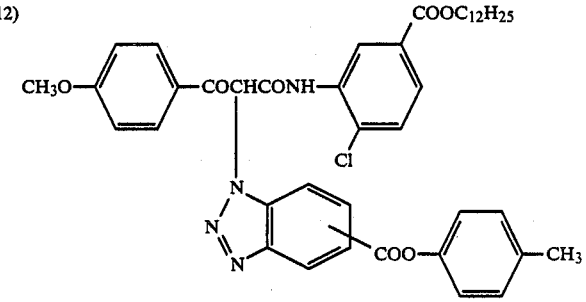

-continued
(14)
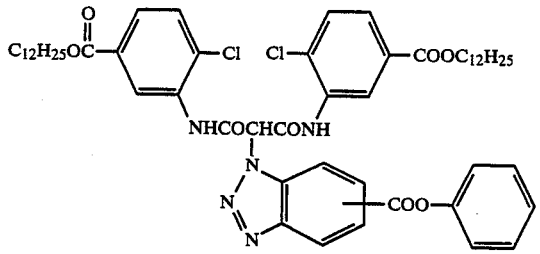
(15)
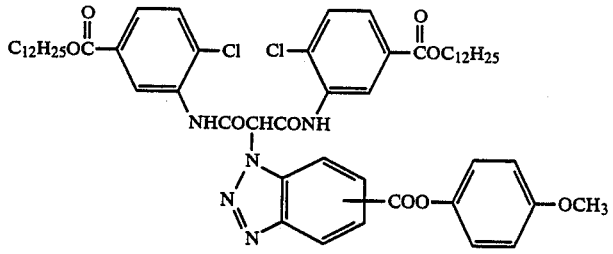
(16)
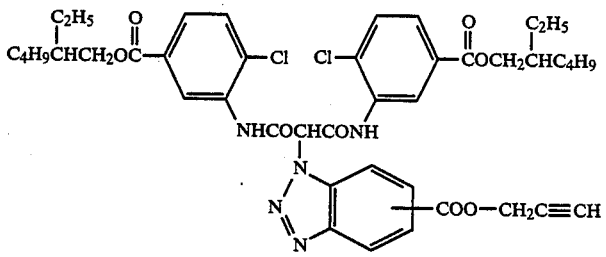
(17)
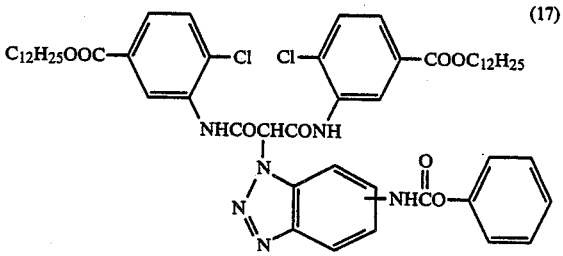
(18)
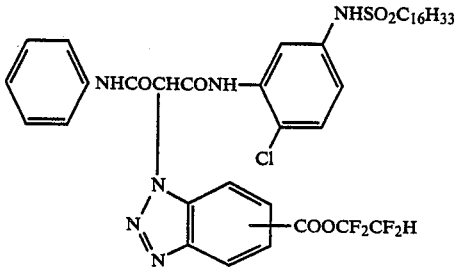
(19)
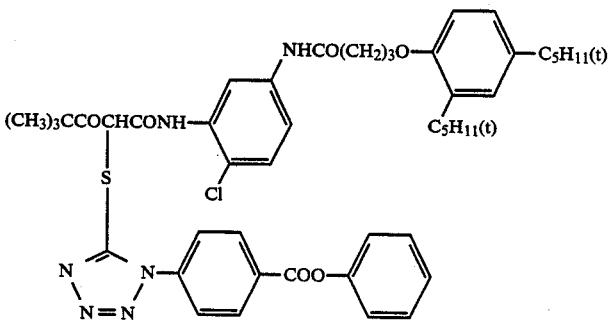

-continued
(20)
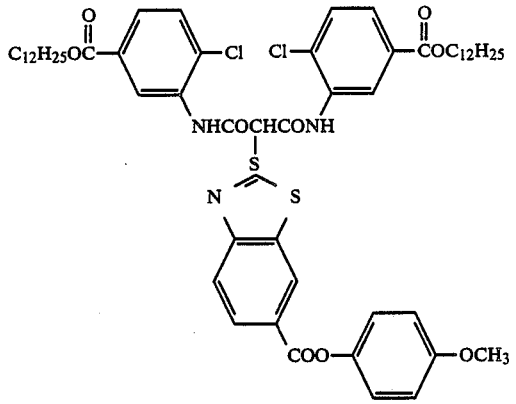
(21)
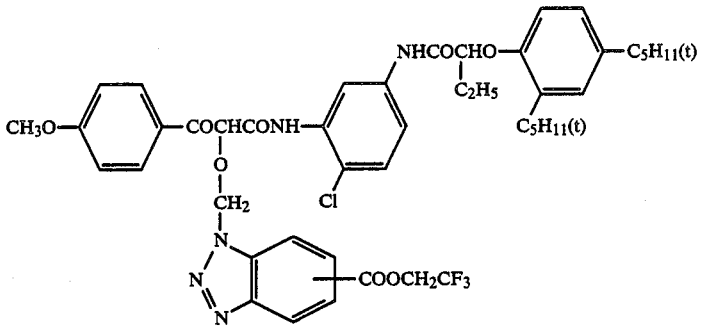
(22)
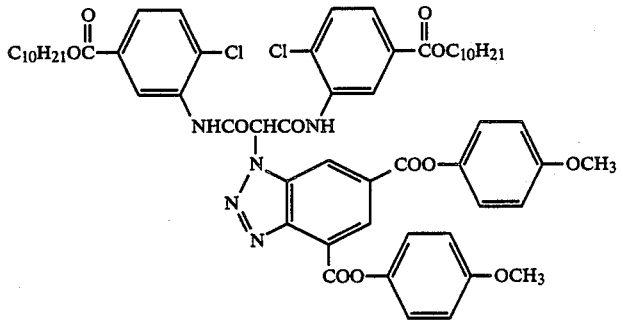
(23)
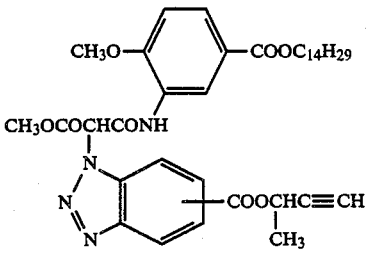
(24)
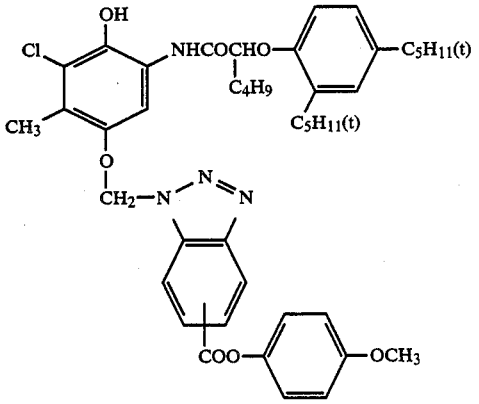

-continued
(25)
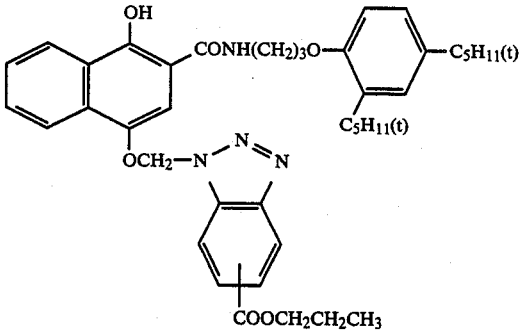
(26)
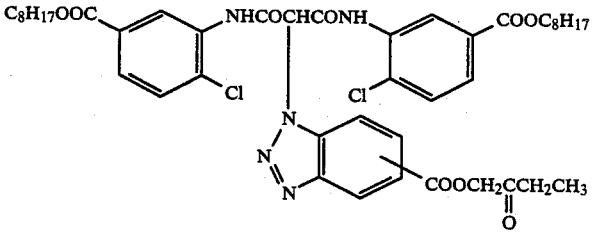
(27)
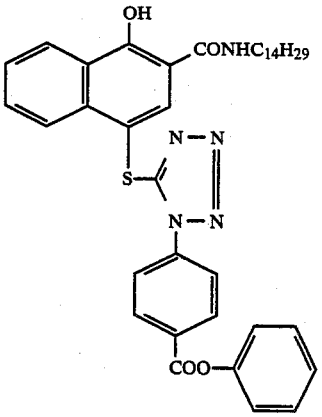
(28)
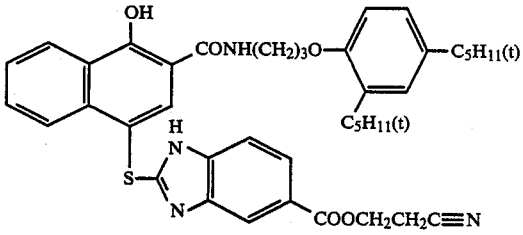
(29)
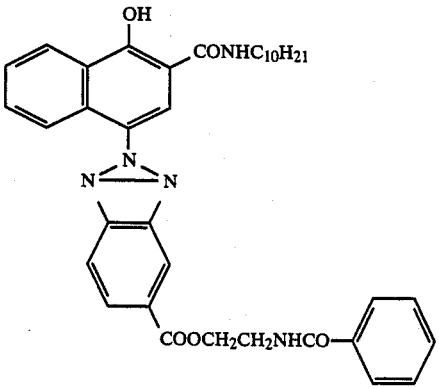
(30)
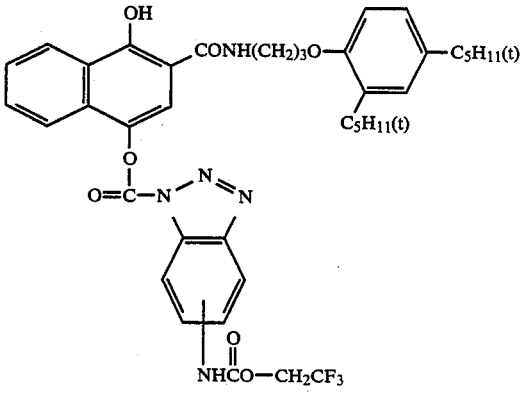

-continued
(31)
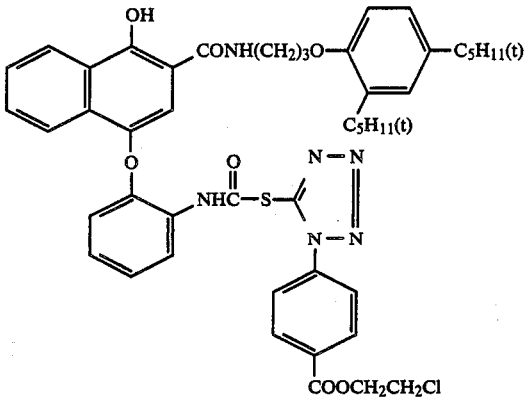
(32)
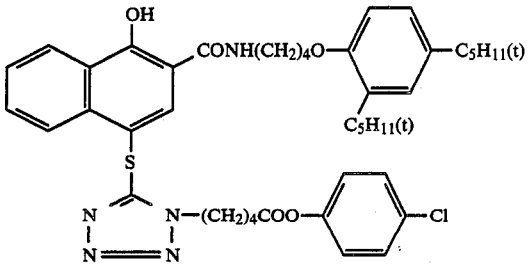
(33)
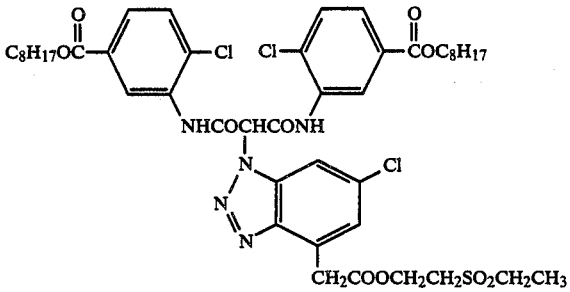
(34)
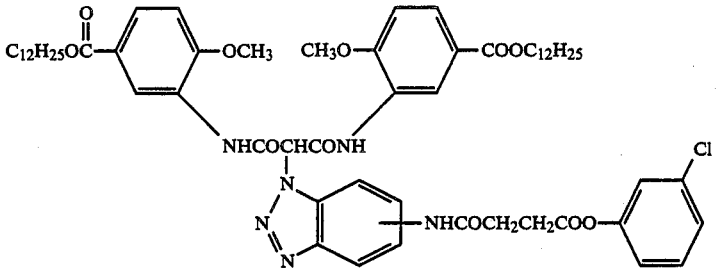
(35)
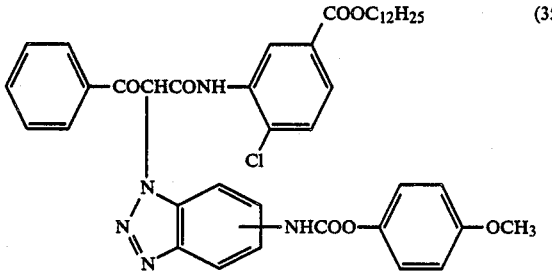
(36)
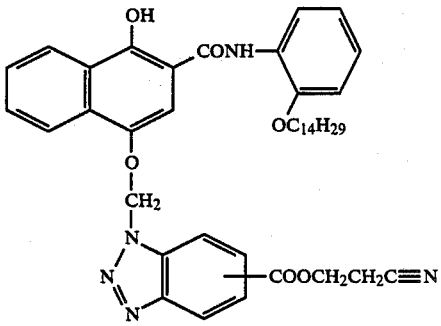
(37)
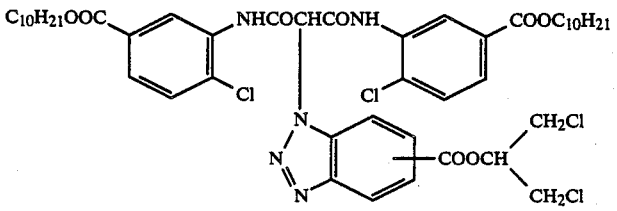

-continued
(38)
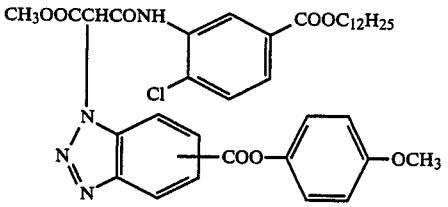
(39)
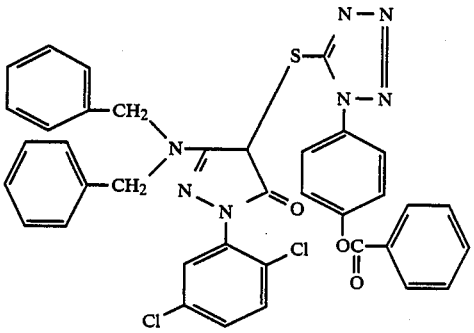
(40)
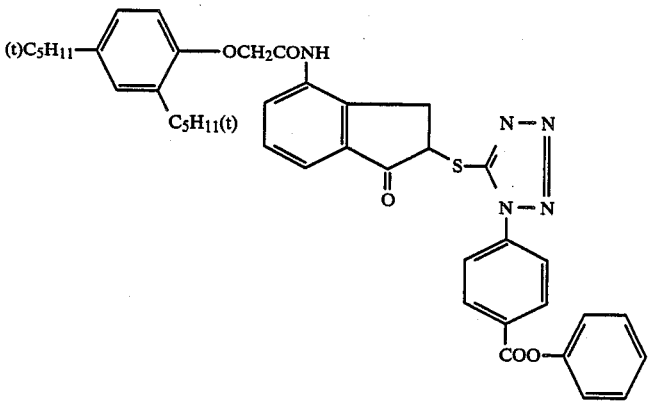
(41)
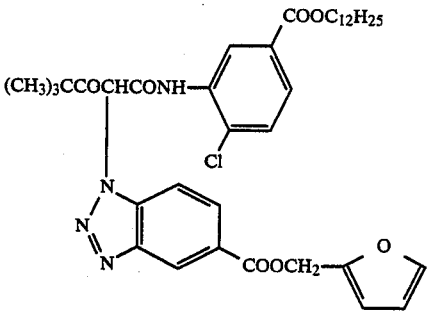
(42)
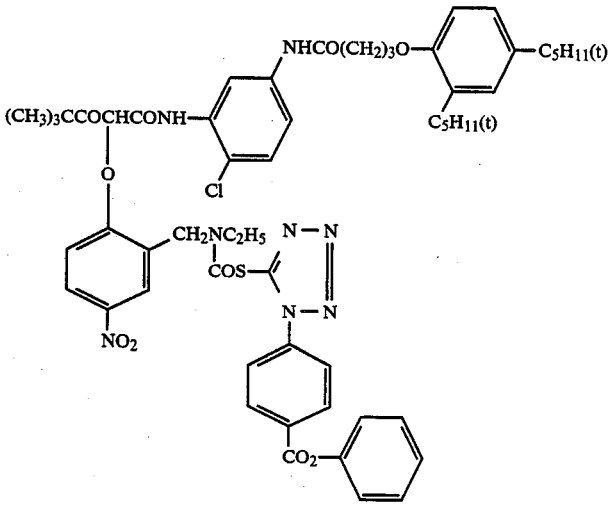

-continued
(43)
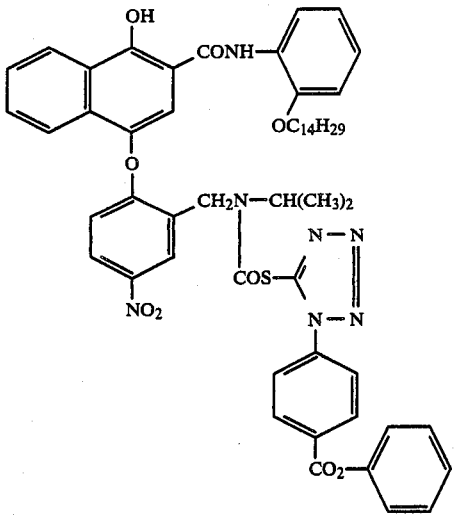
(44)
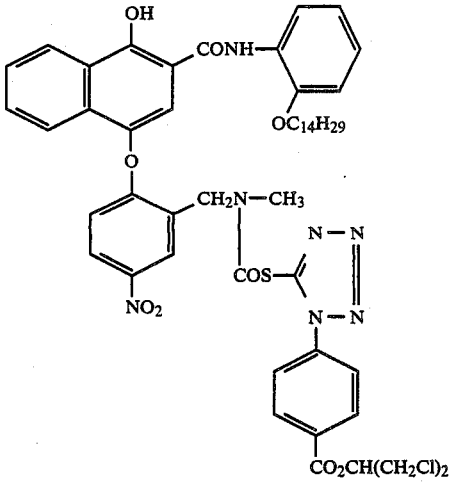
(45)
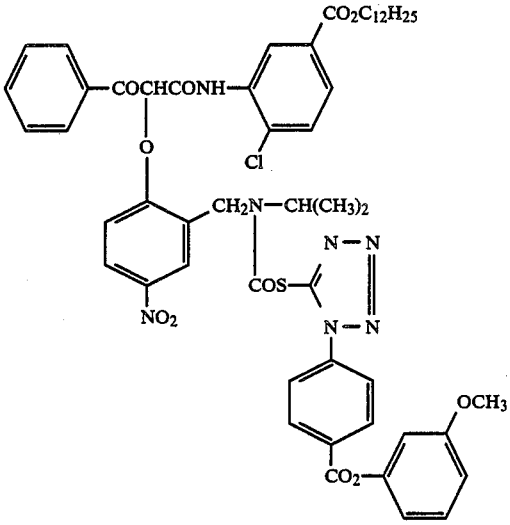
(46)
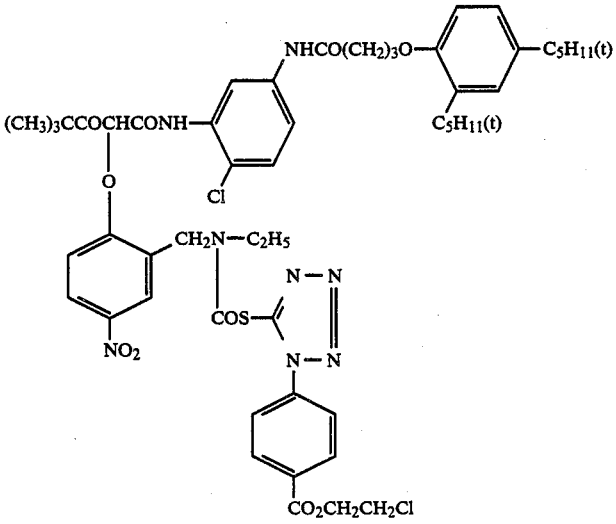

-continued
(47)
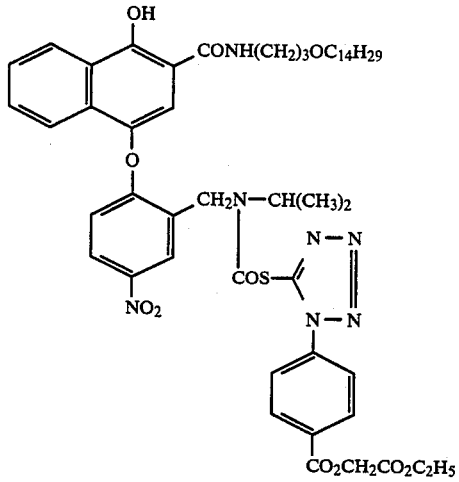
(48)
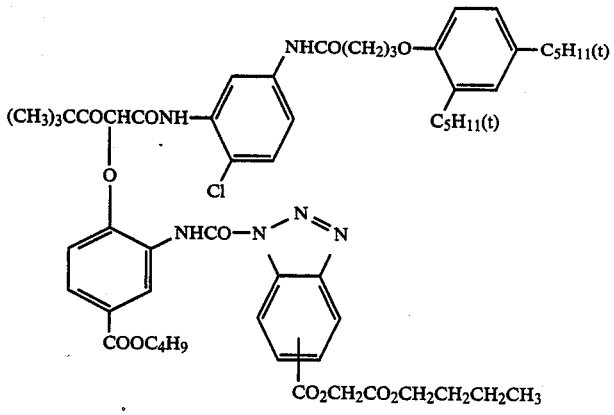
(49)
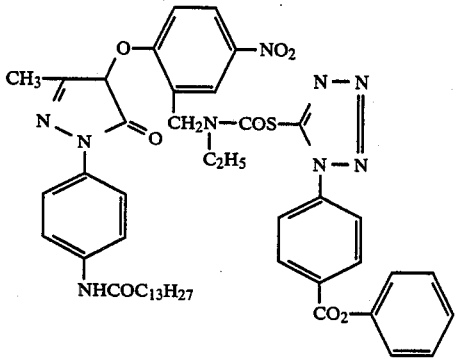
(50)
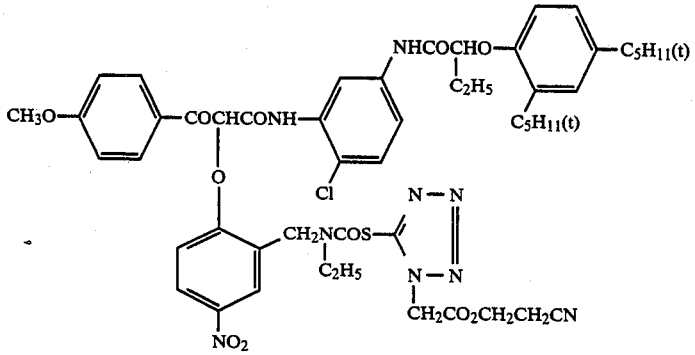

-continued
(51)
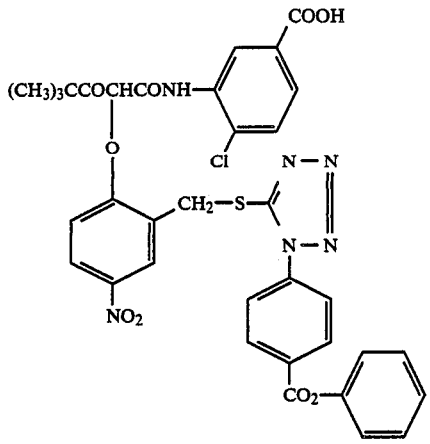
(52)
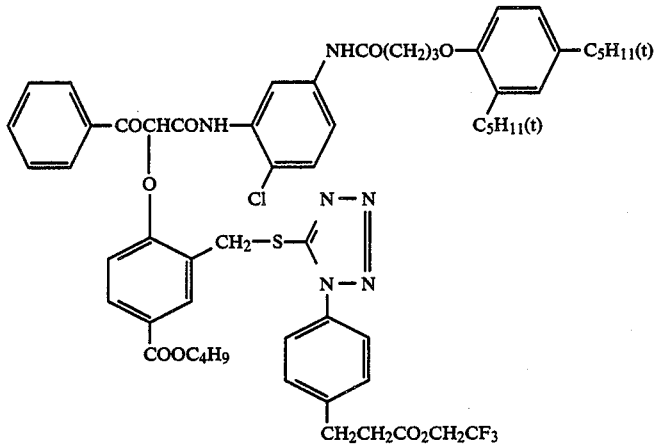
(53)
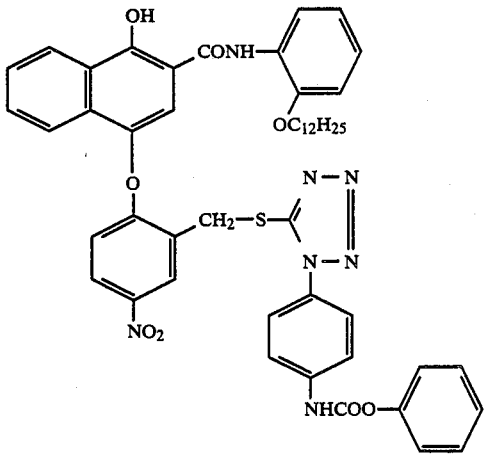

-continued
(54)
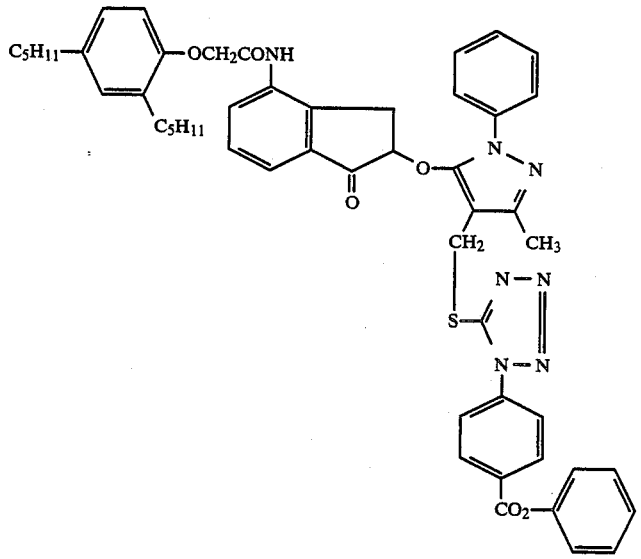
(55)
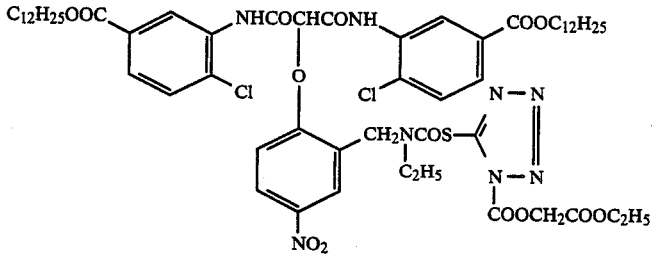
(56)
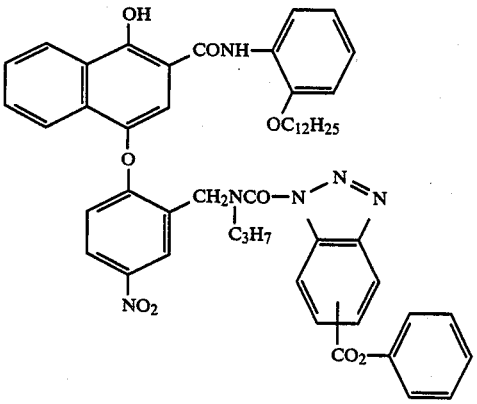
(57)
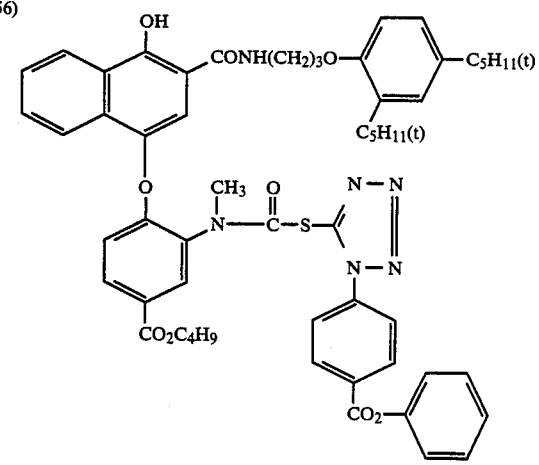

-continued (58)

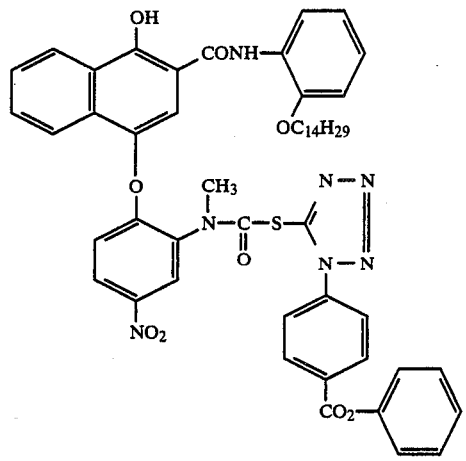

(59)

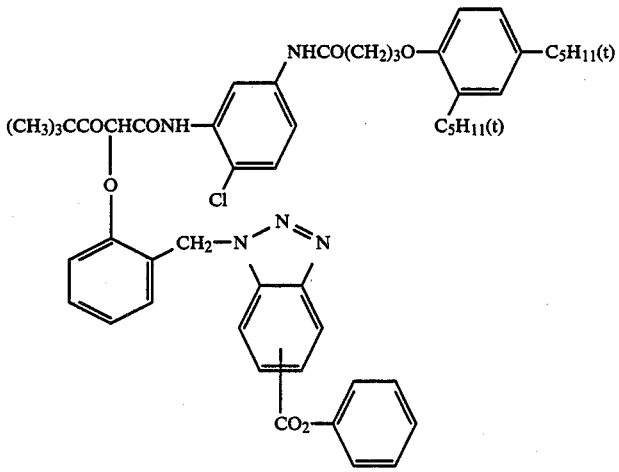

The hydrolysis type DIR couplers to be used in the present invention are known compounds, and can be easily synthesized according to the processes described in Japanese Patent Application (OPI) Nos. 151944/82, 205150/83, etc.

All of these illustrative compounds have a half-value period of 4 hours or shorter than that.

The half-value period of the compounds can be easily determined according to the aforementioned method. Several results are given below.

| Compound No. | Half-Value Period (min.) |
|---|---|
| (1) | 10 |
| (2) | 4.5 |
| (3) | 120 |
| (4) | 4.5 |
| (6) | 120 |
| (7) | 11 |
| (8) | 4.5 |
| (9) | 3 |
| (15) | 11 |
| (16) | 20 |
| (18) | 4.3 |
| (37) | 30 |
| (43) | 4.5 |

These DIR couplers may be added to either of light-sensitive emulsion layers and light-insensitive emulsion layers of light-sensitive materials. They are preferably added in amounts of $1\times10^{-4}$ mol% to $1\times10^{-1}$ mol% based on the total amount of coated silver.

In adding the compounds of the present invention represented by the general formula (I) and/or (II) to light-sensitive materials, they may be added to any one or more of an antihalation layer, an interlayer (between layers having different color sensitivities, between layers having the same color sensitivity, between a light-sensitive layer and a light-insensitive layer, etc.), a light-sensitive silver halide emulsion layer, a light-sensitive silver halide emulsion layer, a yellow filter layer, a protective layer, etc.

Two or more of these compounds may be mixed to add to a light-sensitive material. In this case, the total amount thereof ranges from $1\times10^{-5}$ to $1\times10^{-2}$ mol/m$^2$, preferably $2\times10^{-5}$ to $5\times10^{-3}$ mol/m$^2$, more preferably $5\times10^{-5}$ to $2\times10^{-3}$ mol/m$^2$.

In the case of adding the compounds represented by the general formula (I) to one of the baths in the processing steps, they are added to a bleaching bath, a blix bath or a bath having bleaching power and provided before a particular processing (for example, pre-baths of a developing bath, a bleaching bath, or a blix bath). However, they are preferably added to a developing bath, a bleaching bath or a blix bath.

The amounts of the compounds to be added to these processing baths vary depending upon the kind of photographic materials to be processed, processing temperature, and time required for the intended processing, etc., but as a general guide, are $2\times10^{-4}$ to $1\times10^{-1}$ mol/liter, preferably $5\times10^{-4}$ to $5\times10^{-2}$ mol/liter, more preferably $2\times10^{-3}$ to $5\times10^{-2}$ mol/liter of processing solution.

Addition of these compounds to light-sensitive materials can be conducted by adding, to a coating solution, these compounds as such or as a solution of a proper concentration in a solvent that does not adversely affect silver halide color photographic materials such as water or alcohol. In addition, these compounds may be added by dissolving in a high-boiling and/or low-boiling organic solvent, and emulsifying and dispersing the resulting solution in an aqueous solution.

Upon adding these compounds to processing solutions, they are generally previously dissolved in water, alkali, organic solvent or the like, but may be directly added to processing solutions in the powder form.

In adding the DIR couplers of the present invention to light-sensitive materials, conventionally known processes for adding or dispersing couplers to or in an emulsion and conventional processes for adding the solution or dispersion to the gelatino-silver halide emulsion or hydrophilic colloid may be employed. For example, there may be employed a process of mixing couplers with a high-boiling organic solvent such as dibutyl phthalate, tricresyl phosphate, wax, higher fatty acid and ester thereof, etc., and dispersing the resulting solution (described in, for example, U.S. Pat. Nos. 2,304,939, 2,322,027, etc.), a process of mixing couplers with a low-boiling organic solvent or an aqueous organic solvent and dispersing the resulting mixture, a process of dispersing couplers further using a high-boiling organic solvent (described in, for example, U.S. Pat. Nos. 2,801,170, 2,801,171, 2,949,360, etc.), and a process of dispersing couplers having themselves a low enough melting point (for example, not higher than 75° C.) solely or together with other couplers to be used such as colored couplers or uncolored couplers (described in, for example, German Pat. No. 1,143,707).

As dispersing aids, ordinarily used anionic surfactants (e.g., sodium alkylbenzenesulfonate, dioctyl sulfosuccinate, sodium dodecylsulfate, sodium alkylnaphthalenesulfonate, Fischer type couplers, etc.), amphoteric surfactants (e.g., N-tetradecyl-N,N-dipolyethylene α-betaine, etc.), and nonionic surfactants (e.g., sorbitan monolaurate, etc.) may be used.

The amounts of couplers to be used in the present invention range form 0.01 to 50 mols, preferably 0.02 to 5 mols, per mol of silver halide.

As the silver halide color photographic materials for photographing use to be used in the present invention, there are color negative-working films, reversal films (containing or not containing dye-forming couplers), etc. Color negative-working films for photographing use are particularly preferably used. In these light-sensitive materials, silver is coated in an amount of 1 to 15 g/m$^2$, preferably 3 to 12 g/m$^2$.

Surface latent image-forming silver halides are usually used in the photographic emulsion layers of the light-sensitive material to be used in the present invention.

In the photographic emulsion layer of light-sensitive material to be used in the present invention, any silver halide of silver bromide, silver bromoiodide, silver chlorobromoiodide, silver chlorobromide, and silver chloride may be used. Preferable silver halides are silver bromoiodide or silver chlorobromoiodide containing up to 30 mol% iodide, with silver bromoiodide containing 2 mol% to 25 mol% silver iodide being particularly preferable.

Silver halide grains in the photographic emulsion may be so-called regular grains having regular crystal form such as cubic, octahedral or tetradecahedral form, grains having irregular form such as spherical form grains having crystal defect such as twin plane, or grains having mixed forms thereof.

Grain sizes of the silver halide may be as fine as 0.1μ or less, or may be as large as up to 10μ in projected area diameter, and the emulsion may be a monodispersed emulsion having a broad distribution.

The silver halide photographic emulsion to be used in the present invention may be prepared in a conventional manner described in, for example, *Research Disclosure,* RD No. 17643 (December 1978), pp. 22–23, under the title of "Emulsion preparation and types", and ibid., No. 18716 (November 1979), p. 648.

The monodispersed emulsion is typically an emulsion which contains silver halide grains having a mean grain diameter of about 0.1μ or more, with at least 95 wt% thereof being within ±40% of the mean grain diameter. Emulsions containing silver halide grains having a mean grain diameter of 0.25μ to 2μ, with at least 95% by weight or in number of the grains being within the scope of ±20% of the mean grain diameter, may be used in the present invention.

In addition, tabular grains having an aspect ratio of 5 or more may also be used in the present invention. Tabular grains may be easily prepared according to the processes described in Gutoff; *Photographic Science and Engineering,* Vol. 14, pp. 248–257 (1970), U.S. Pat. Nos. 4,434,226, 4,414,310, 4,433,048, 4,439,520, and British Pat. No. 2,112,157, etc. Where tabular grains are used, color-sensitizing efficiency with sensitizing dye, graininess, and sharpness are improved as described in detail in U.S. Pat. No. 4,434,226 cited above, etc.

Crystal structure may be uniform or of a layered structure wherein the inner portion and the outer portion are different in halide composition, or silver halide crystals different from each other in composition may be conjuncted by epitaxial conjunction or, further, may be conjuncted with a compound other than silver halide such as silver rhodanide or lead oxide. Silver halide crystals comprising a mixture of various crystal forms may also be used.

The emulsion of the present invention is usually subjected to physical ripening, chemical ripening, and spectral sensitization. Additives to be used in these steps are described in *Research Disclosure,* Vol. 176, No. 17643 (December 1978), and ibid., Vol. 187, No. 18716 (November 1979) on pages tabulated in the following table.

Known photographic additives to be used in the present invention are also described in the above-cited two *Research Disclosure* articles on the pages shown in the following table.

| Kind of Additives | RD 17643 | RD 18716 |
|---|---|---|
| 1. Chemical sensitizing agent | Page 23 | Page 648, right column |
| 2. Sensitivity-increasing | | Page 648, right column |

-continued

| Kind of Additives | RD 17643 | RD 18716 |
|---|---|---|
| Agent | | |
| 3. Spectrally sensitizing agent | Pages 23 to 24 | Page 648, right column to Page 649, right column |
| 4. Supersensitizing agent | | Page 648, right column to Page 649, right column |
| 5. Brightening agent | Page 24 | |
| 6. Antifoggants and Stabilizers | Pages 24 to 25 | Page 649, right column |
| 7. Light-Absorbing agent, Filter dyes, and UV ray absorbers | Pages 25 to 26 | Page 649, right column to Page 650, left column |
| 8. Stain-preventing agent | Page 25, right column | Page 650, left column to right column |
| 9. Dye image-stabilizing agent | Page 25 | |
| 10. Hardener | Page 26 | Page 651, left column |
| 11. Binder | Page 26 | Page 651, left column |
| 12. Plasticizer and Lubricant | Page 27 | Page 650, right column |
| 13. Coating aid and surfactant | Pages 26 to 27 | Page 650, right column |
| 14. Antistatic agent | Page 27 | Page 650, right column |

Various color couplers may be used in the present invention, and specific examples thereof are described in the patents referred to in *Research Disclosure,* RD No. 17643, VII to G. As dye-forming couplers, those which give three primary colors in subtractive color photography (i.e., yellow, magenta, and cyan) upon color development are of importance. Specific examples of diffusion-resistant, 4-equivalent or 2-equivalent couplers described below may preferably be used in the present invention as well as those couplers described in the foregoing *Research Disclosure,* RD No. 17643, items VII-C and D.

Typical examples of yellow couplers to be used in the present invention are hydrophobic acylacetamide type couplers having a ballast group. Specific examples thereof are described in U.S. Pat. Nos. 2,407,210, 2,875,057, 3,265,506, etc. In the present invention, the use of 2-equivalent yellow couplers is preferable, and typical examples thereof include yellow couplers of oxygen atom coupling-off type described in U.S. Pat. Nos. 3,408,194, 3,447,928, 3,933,501 and 4,022,620 and yellow couplers of nitrogen atom coupling-off type described in Japanese Patent Publication No. 10739/83, U.S. Pat. Nos. 4,401,752, 4,326,024, *Research Disclosure,* RD No. 18053 (April 1979), British Pat. No. 1,425,020, West German Patent Application (OLS) Nos. 2,219,917, 2,261,361, 2,329,587, 2,433,812, etc. Alpha-pivaloy-lacetanilide type couplers are excellent in fastness, particularly light fastness, of colored dyes, whereas α-benzoylacetanilide type couplers provide high coloration density.

Magenta couplers to be used in the present invention include hydrophobic indazolone or cyanoacetyl, preferably 5-pyrazolone and pyrazoloazole couplers. Of the 5-pyrazolone couplers, those which are substituted by an arylamino group or an acylamino group in the 3-position are preferable in view of hue and coloration density of colored dyes. Typical examples thereof are described in U.S. Pat. Nos. 2,311,082, 2,343,703, 2,600,788, 2,908,573, 3,062,653, 3,152,896, 3,936,015, etc. As coupling-off groups of 2-equivalent, 5-pyrazolone couplers, nitrogen atom coupling-off groups described in U.S. Pat. No. 4,310,619 and arylthio groups described in U.S. Pat. No. 4,351,897, are particularly preferable. Ballast group-having, 5-pyrazolone couplers described in European Pat. No. 73,636 provide high coloration density. As pyrazoloazole type couplers, there are illustrated pyrazolobenzimidazoles described in U.S. Pat. No. 3,369,879, preferably pyrazolo[5,1-c][1,2,4]triazoles described in U.S. Pat. No. 3,725,067, pyrazolotetrazoles described in *Research Disclosure,* RD No. 24220 (June 1984) and Japanese Patent Application (OPI) No. 33552/85 and pyrazolopyrazoles described in *Research Disclosure,* RD No. 24230 (June 1984) and Japanese Patent Application (OPI) No. 43659/85. Imidazo[1,2-b]pyrazoles described in U.S. Pat. No. 4,500,630 are preferable in view of little side yellow absorption of formed dyes, and pyrazolo[1,5-b][1,2,4]triazoles described in European Pat. No. 119,860A are particularly preferable.

Cyan couplers to be used in the present invention include hydophobic naphtholic and phenolic couplers. Typical examples thereof include naphtholic couplers described in U.S. Pat. No. 2,474,293, preferably oxygen atom coupling-off type 2-equivalent naphtholic couplers described in U.S. Pat. Nos. 4,052,212, 4,146,396, 4,228,233 and 4,286,200. Specific examples of the phenolic couplers are described in U.S. Pat. Nos. 2,369,929, 2,801,171, 2,772,162, 2,895,826, etc. Cyan couplers fast against high humidity and high temperature are preferably used in the present invention, and typical examples thereof include phenolic cyan couplers having an ethyl or more alkyl group at the m-position of the phenol nucleus described in U.S. Pat. No. 3,772,002, 2,5-diacylamino-substituted phenolic couplers described in U.S. Pat. Nos. 2,772,162, 3,758,308, 4,126,396, 4,334,011, 4,327,173, West German Patent Application (OLS) No. 3,329,729, European Pat. No. 121,365, etc., phenolic couplers having a phenylureido group in the 2-position and an acylamino group in the 5-position, described in U.S. Pat. Nos. 3,446,622, 4,333,999, 4,451,559, 4,247,767, etc., and naphtholic cyan couplers described in Japanese Patent Application No. 93,605/84, etc.

In order to eliminate unnecessary absorption of dyes formed, colored couplers are preferably used together in light-sensitive materials to be used in the present invention. Typical examples thereof include yellow colored magenta couplers described in U.S. Pat. No. 4,163,670, Japanese Patent Publication No. 39413/82, etc., and magenta colored cyan couplers described in U.S. Pat. Nos. 4,004,929 and 4,138,258, British Pat. No.

1,146,368, etc. Other colored couplers are described in foregoing *Research Disclosure,* RD No. 17643, VII-G.

Graininess can be improved by using those couplers which form dyes with proper diffusibility. As such couplers, U.S. Pat. No. 4,366,237 and British Pat. No. 2,125,570 described specific examples of magenta couplers, and European Pat. No. 96,570 and West German Patent Application (OLS) No. 3,234,533 describe specific examples of yellow, magenta or cyan couplers.

The dye-forming couplers and the above-described specific couplers may be in a dimer or polymer form. Typical examples of polymerized dye-forming couplers are described in U.S. Pat. Nos. 3,451,820 and 4,080,211. Specific examples of polymerized magenta couplers are described in British Pat. No. 2,102,173 and U.S. Pat. No. 4,367,282.

Suitable supports to be used in the present invention are described in, for example, the foregoing *Research Disclosure,* RD No. 17643, p. 28 and ibid., No. 18716, p. 647, right column to p. 648, left column.

The light-sensitive material of the present invention can take various stratum structures. For example, multilayered stratum structure of emulsion layers represented in British Pat. No. 923,045 and French Pat. No. 2,043,433 are commonly employed. Further, a gelatin layer or a light-insensitive interlayer containing a diffusion-resistant coupler dispersion may be provided between a more sensitive layer and a less sensitive layer.

In the light-sensitive material of the present invention may preferably be provided a fine-grain emulsion layer. Such fine-grain emulsion layer may be provided anywhere, but is preferably provided at an outer position relative to the emulsion layers. The fine-grain emulsion is preferably added in an amount of 0.05 g to 1 g, but may be increased or decreased depending upon the amount of DIR coupler used, and the development-inhibiting degree and hydrolysis rate of a released development inhibitor. The fine-grain emulsion layer contains grain having preferably a mean grain size of 0.1$\mu$ or less and a mean iodide content of 10 mol% or less.

The color photographic material in accordance with the present invention may be developed in a conventional manner described in the aforementioned *Research Disclosure,* RD No. 17643, pp. 28–29 and ibid., RD No. 18716, p. 651, left column to right column.

The amount of replenishing developer is not more than 700 ml, preferably not more than 600 ml, more preferably not more than 500 ml, per $m^2$ of light-sensitive materials.

In photographic processing of the light-sensitive material of the present invention, any of known processes and known processing solutions may be used. Processing temperature is usually selected between 18° C. to 50° C. However, temperature lower than 18° C. or higher than 50° C. may be employed.

Color developer generally comprises an alkaline aqueous solution containing a color developing agent. As the color developing agent, known primary aromatic amine developing agents such as phenylenediamines (e.g., 4-amino-N,N-diethylaniline, 3-methyl-4-amino-N,N-diethylaniline, 4-amino-N-ethyl-N-$\beta$-hydoxyethylaniline, 3-methyl-4-amino-N-ethyl-N-$\beta$-hydroxyethylaniline, 3-methyl-4-amino-N-ethyl-N-$\beta$-methanesulfonamidoethylaniline, 4-amino-3-ethyl-N-amino-N-$\beta$-methoxyethylaniline, etc.) may be used.

In addition, those described in L. F. A. Mason; "Photographic Processing Chemistry" (Focal Press, 1966), pp. 266–299, U.S. Pat. Nos. 2,193,015 and 2,592,364, Japanese Patent Application (OPI) No. 64933/73, etc., may also be used.

The color developer may further contain pH buffers such as alkali metal sulfites, carbonates, borates, and phosphates, development inhibitors or antifoggants, such as bromides, iodides, and organic antifoggants and, if necessary, may contain water softeners, preservatives such as hydroxylamine, organic solvents such as benzyl alcohol and diethylene glycol, development accelerators such as polyethylene glycol, quaternary ammonium salts, and amines, dye-forming couplers, competitive couplers, fogging agents such as sodium borohydride, auxiliary developing agents such as 1-phenyl-3-pyrazolidone, viscosity-increasing agents, polycarboxylic acid type chelating agents described in U.S. Pat. No. 4,083,723, antioxidants described in West German Patent (OLS) No. 2,622,950, and the like.

After color photographic processing, the color-developed photographic light-sensitive materials are usually bleached.

As bleaching agents to be used in bleaching or bleach-fixing compounds of polyvalent metals such as iron (III), cobalt (III), chromium (VI), copper (II), etc., peracids, quinones, nitroso compounds, etc., are used. For example, ferricyanides, dichromates, organic complex salts of iron (III) or cobalt (III) such as complex salts of the following aminopolycarboxylic acids or the salts thereof (e.g., ammonium salts, sodium salts, etc.)

A-1 Ethylenediaminetetraacetic acid
A-2 Diethylenetriaminepentaacetic acid
A-3 Trimethylenediaminetetraacetic acid
A-4 Propylenediaminetetraacetic acid
A-5 Cyclohexane-1,2-diaminetetraacetic acid
A-6 Glycol ether diaminetetraacetic acid
A-7 Nitrilotriacetic acid
A-8 Triethylenetetraaminehexaacetic acid
A-9 Tetramethylenediaminetetraacetic acid
A-10 Pentamethylenediaminetetraacetic acid
A-11 Hydroxyethylethylenediaminetriacetic acid or organic acids (e.g., citric acid, tartaric acid, malic acid, etc.); persulfates and permanganates; nitrosophenol; etc., may be used.

These bleaching agents can be used singly or in combination with each other in any desired fashion. For example, a combination of A-1 and A-3, A-1 and A-5, etc., can be used. Of these, potassium ferricyanide, iron (III) sodium ethylenediaminetetraacetate and iron (III) ammoninum ethylenediaminetetraacetate are particularly useful. Iron (III) ethylenediaminetetraacetate complex salt is useful in both an independent bleaching solution and a mono-bath bleaching-fixing solution.

To the bleaching or bleach-fixing solution and/or pre-baths thereof may be added various compounds as bleaching accelerators. For example, mercapto group- or disulfido group-containing compounds described in U.S. Pat. No. 3,893,858, German Patent No. 1,290,812, *Research Disclosure,* RD No. 17129 (July 1978) may be used.

Photographic processings to be used in the present invention comprise the aforesaid color development, bleaching and, in addition, fixing, etc. After the fixing or bleach-fixing step, such processing steps as washing with water and stabilizing are generally conducted.

The bleaching solution is usually used at a pH of about 6.0. With silver-removing properties, a lower pH is preferable. A pH of 5.7 to 4.0 is preferable. Particularly remarkable effects can be obtained by combining the DIR coupler and silver removal accelerator and reduction in pH of the bleaching solution.

In the water-washing step and the stabilizing step, known additives may be used, if desired. For example, chelating agents such as inorganic phosphoric acid, aminopolycarboxylic acids, organophosphoric acids, etc., antibacterial agents and antifungal agents for preventing growth of various bacteria, algae, fungi, etc., hardeners such as magnesium salts and aluminum salts, surfactants for reducing drying load or preventing drying unevenness, etc., may be added as the case demands. Or, those compounds which are described in L. E. West; "Water Quality Criteria", *Phot. Sci. Eng.*, Vol. 9, No. 6, pp. 344–359 (1965), etc., may be added. The water-washing step may be conducted using, if desired, two or more baths. A multi-stage (for example, 2 to 9 stages) countercurrent water-washing may be conducted to save washing water. When saving of washing water is conducted it is preferred to reduce the concentration of calcium and magnesium ions to 5 mg/l or less in order to prevent growth of bacteria, algae, fungi, etc.

As the stabilizing solution to be used in the stabilizing step, a processing solution capable of stabilizing the dye image is used. For example, a solution having a buffering ability of pH 3 to 6, a solution containing an aldehyde (e.g., formaldehyde), etc., may be used. In the stabilizing solution may be used a fluorescent brightening agent, a bactericide, a fungicide, a hardener, a surfactant, etc.

The stabilizing step may be conducted using, if necessary, two or more baths. Multi-stage (for example, 2 to 9 stages) countercurrrent stabilization may be employed to save the stabilizing solution, and the water-washing step may be eliminated.

All of the light-sensitive materials to which the process of the present invention is applied preferably contain the specific DIR couplers of the present invention. However, the effects of the present invention may be obtained to some extent by processing light-sensitive materials not containing such DIR couplers together with the light-sensitive materials containing the DIR couplers (for example, in an alternative manner). In such case, the proportion of the light-sensitive materials not containing the DIR coupler is preferably not more than 80%, preferably not more than 50%.

The present invention enables reduction in the amount of replenishing developer with scarce deterioration of photographic properties such as sensitivity, and shortens the time required for the silver-removing step without deterioration of silver-removing properties.

The present invention is now illustrated in greater detail by reference to the following examples which, however, are not to be construed as limiting the present invention in any way.

Unless otherwise specified, all ratios, percents, etc., are by weight.

EXAMPLE 1

Multilayer color light-sensitive materials, samples 101 to 107, comprising a subbed cellulose triacetate film support having provided thereon layers of the following formulations were prepared.

Formulation of light-sensitive layer

Coating amounts of silver halide and colloidal silver were prepared in terms of g of silver/m$^2$, that of couplers, additives, and gelatin were presented as g/m$^2$, and that of sensitizing dye in terms of mol number per mol of silver halide existing in the same layer. DIR couplers were used in such amounts that gradation of each sample became almost the same. Kinds and amounts thereof used are tabulated in Table 1.

1st layer (Antihalation layer)
- Black colloidal silver: 0.2
- Gelatin: 1.3
- Colored coupler C-1: 0.06
- UV ray absorbent UV-1: 0.1
- UV ray absorbent UV-2: 0.2
- Dispersing oil Oil-1: 0.01
- Dispersing oil Oil-2: 0.01

2nd layer (Interlayer)
- Fine-grain silver bromide (mean grain size: 0.07$\mu$): 0.15
- Gelatin: 1.0
- Colored coupler C-2: 0.02
- Dispersing oil Oil-1: 0.1

3rd layer (First red-sensitive emulsion layer)
- Silver bromoiodide emulsion (Silver iodide: 2 mol%; mean grain size: 0.3$\mu$): 0.4
- Gelatin: 0.6
- Sensitizing Dye I: $1.0\times10^{-4}$
- Sensitizing Dye II: $3.0\times10^{-4}$
- Sensitizing Dye III: $1\times10^{-5}$
- Coupler C-3: 0.06
- Coupler C-4: 0.06
- DIR coupler: shown in Table 1
- Coupler C-2: 0.03
- Dispersing oil Oil-1: 0.03
- Dispersing oil Oil-3: 0.012

4th layer (Second red-sensitive emulsion layer)
- Silver bromoiodide emulsion (Silver iodide: 5 mol%; mean grain size: 0.5$\mu$): 0.7
- Sensitizing Dye I: $1\times10^{-4}$
- Sensitizing Dye II: $3\times10^{-4}$
- Sensitizing Dye III: $1\times10^{-5}$
- Coupler C-3: 0.24
- Coupler C-4: 0.24
- DIR coupler: shown in Table 1
- Coupler C-2: 0.04
- Dispersing oil Oil-1: 0.05
- Dispersing oil Oil-3: 0.10

5th layer (Third red-sensitive emulsion layer)
- Silver bromoiodide emulsion (Silver iodide: 10 mol%; mean grain size: 0.7$\mu$): 1.0
- Gelatin: 1.0
- Sensitizing Dye I: $1\times10^{-4}$
- Sensitizing Dye II: $3\times10^{-4}$
- Sensitizing Dye III: $1\times10^{-5}$
- Coupler C-6: 0.05
- Coupler C-7: 0.1
- Coupler C-2: 0.03
- Dispersing oil Oil-1: 0.01
- Dispersing oil Oil-2: 0.05

6th layer (Interlayer)
- Gelatin: 1.0
- Compound Cpd-A: 0.03
- Dispersing oil Oil-1: 0.05

7th layer (First green-sensitive emulsion layer)
- Silver bromoiodide emulsion (Silver iodide: 4 mol%; mean grain size: 0.3$\mu$): 0.30
- Sensitizing Dye IV: $5\times10^{-4}$
- Sensitizing Dye V: $2\times10^{-4}$
- Gelatin: 1.0
- Coupler C-9: 0.2
- DIR coupler: shown in Table 1
- Coupler C-1: 0.03
- Dispersing oil Oil-1: 0.5

8th layer (Second green-sensitive emulsion layer)
Silver bromoiodide emulsion (Silver iodide: 5 mol%; mean grain size: 0.5μ): 0.4
Sensitizing Dye VI: $5\times10^{-4}$
Sensitizing Dye V: $2\times10^{-4}$
Coupler C-9: 0.25
Coupler C-1: 0.03
Coupler C-10: 0.015
DIR coupler: shown in Table 1
Dispersing oil Oil-1: 0.2

9th layer (Third green-sensitive emulsion layer)
Silver bromoiodide emulsion (Silver iodide: 6 mol%; mean grain size: 0.7μ): 0.85
Gelatin: 1.0
Sensitizing Dye IV: $3.5\times10^{-4}$
Sensitizing Dye V: $1.4\times10^{-4}$
Coupler C-11: 0.05
Coupler C-12: 0.01
Coupler C-13: 0.08
Coupler C-1: 0.02
Dispersing oil Oil-1: 0.10
Dispersing oil Oil-2: 0.05

10th layer (Yellow filter layer)
Gelatin: 1.2
Yellow colloidal silver: 0.08
Compound Cpd-B: 0.1
Dispersing oil Oil-1: 0.3

11th layer (First blue-sensitizing emulsion layer)
Monodispersed silver bromoiodide emulsion (Silver iodide: 4 mol%; mean grain size: 0.3μ): 0.4
Gelatin: 1.0
Sensitizing Dye V: $2\times10^{-4}$
Coupler C-14: 0.9
DIR Coupler: Shown in Table 1
Dispersing oil Oil-1: 0.2

12th layer (Second blue-sensitive emulsion layer)
Silver bromoiodide emulsion) (Silver iodide: 10 mol%; mean grain size: 1.5μ): 0.5
Gelatin: 0.6
Sensitizing Dye V: $1\times10^{-4}$
Coupler C-14: 0.25
Dispersing oil Oil-1: 0.07

13th layer (First protective layer)
Gelatin: 0.8
UV ray absorbent UV-1: 0.1
UV ray absorbent UV-2: 0.2
Dispersing oil Oil-1: 0.01
Dispersing oil Oil-2: 0.01

14th layer (Second protective layer)
Gelatin: 0.45
Polymethyl methacrylate particles (diameter: 1.5μ): 0.2
Hardener H-1: 0.4
Formaldehyde scavenger S-1: 0.5
Formaldehyde scavenger S-2: 0.5

In addition to the above-described ingredients, a surfactant was added to respective layers.

These light-sensitive elements were subjected to 25 CMS exposure using a tungsten light source fitted with a filter to adjust color temperature to 4800 K., then developed at 38° C. according to the following processing steps using an automatic developing machine.

Color development: 3'15"
Bleaching: 6'30"
Washing with water: 2'10"
Fixing: 4'20"
Washing with water: 3'15"
Stabilizing: 1'05"

Formulations of the initial developer and the replenishing developer are as shown below.

| | Initial Developer | Replenishing Developer |
|---|---|---|
| Diethylenetriaminepenta-acetic acid | 0.8 g | 0.8 g |
| 1-Hydroxyethylidene-1,1-diphosphonic acid | 3.3 g | 3.3 g |
| Sodium sulfite | 4.0 g | 4.5 g |
| Potassium carbonate | 30.0 g | 39.0 g |
| Potassium bromide | 1.4 g | 0 |
| Potassium iodide | 1.3 mg | 0 |
| Hydroxylamine sulfate | 2.4 g | 3.0 g |
| 4-(N—Ethyl-N—β-hydroxy-ethylamino)-2-methylaniline sulfate | 4.5 g | 6.3 g |
| Water to make | 1.0 liter | 1.0 liter |
| pH | 10.0 | 10.0 |

The amount of replenishing developer was 600 ml/m², and pH was adjusted with potassium hydroxide or sulfuric acid.

Bleaching solution:
Ferric ammonium ethylenediaminetetraacetate: 100.0 g
Disodium ethylenediaminetetraacetate: 10.0 g
Ammonium bromide: 150.0 g
Ammonium nitrate: 10.0 g
Water to make: 1 liter
pH: 6.0

Fixing solution:
Disodium ethylenediaminetetraacetate: 1.0 g
Sodium sulfite: 4.0 g
Ammonium thiosulfate aq. soln. (70%): 175.0 ml
Sodium bisulfite: 4.6 g
Water to make: 1.0 liter
pH: 6.6

Stabilizing solution:
Formalin (40%): 2.0 ml
Polyoxyethylene-p-nonylphenyl ether (polymerization degree=10): 0.3 g
Water to make: 1.0 liter Sensitivity of the samples (at a portion giving a density of fog+0.2) obtained immediately after starting the automatic developing machine and that obtained 10 days after starting the machine (after running 500 m of 35- mm film) were determined. Kinds and half-value periods of DIR couplers used in respective samples and variation of sensitivity obtained 10 days after starting the machine with that immediately after starting the machine are tabulated in Table 1.

TABLE 1

| Sample No. | DIR Coupler Kind | Amount Used (g/m²) 3rd | 4th | 7th | 8th | 11th | Half-value Period (min.) | Variation of Sensitivity After Running Processing |
|---|---|---|---|---|---|---|---|---|
| 101 (*) | A | 0.04 | 0.04 | 0.03 | 0.03 | 0.07 | not decomposed | −0.15 |
| 102 (*) | B | 0.05 | 0.06 | 0.04 | 0.04 | 0.08 | not decomposed | −0.16 |

TABLE 1-continued

| Sample No. | DIR Coupler Kind | Amount Used ($g/m^2$) 3rd | 4th | 7th | 8th | 11th | Half-value Period (min.) | Variation of Sensitivity After Running Processing |
|---|---|---|---|---|---|---|---|---|
| 103 (*) | C | 0.04 | 0.04 | 0.03 | 0.03 | 0.07 | not decomposed | −0.09 |
| 104 (**) | (2) | 0.04 | 0.04 | 0.03 | 0.03 | 0.07 | 4.5 | 0 |
| 105 (**) | (15) | 0.04 | 0.04 | 0.03 | 0.03 | 0.07 | 11.0 | −0.01 |
| 106 (**) | (43) | 0.04 | 0.04 | 0.03 | 0.03 | 0.07 | 4.5 | −0.02 |
| 107 (*) | D | 0.04 | 0.04 | 0.03 | 0.03 | 0.07 | 540 | −0.10 |

(*) comparative example
(**) example of the present invention

As is clear from the results shown in Table 1. mere reduction in the amount of replenishing developer results in serious variation of sensitivity in running processing (serious desensitization), but the process of the present invention can almost completely prevent desensitization.

Chemical structures or chemical names of the compounds used in the above-described samples are shown below.

UV-1

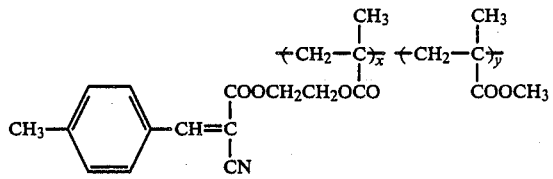

x/y = 7/3 (by weight)

UV-2

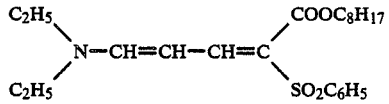

Oil-1: Tricresyl phosphate
Oil-2: Dibutyl phthalate
Oil-3: Bis(2-ethylhexyl)phthalate

C-1

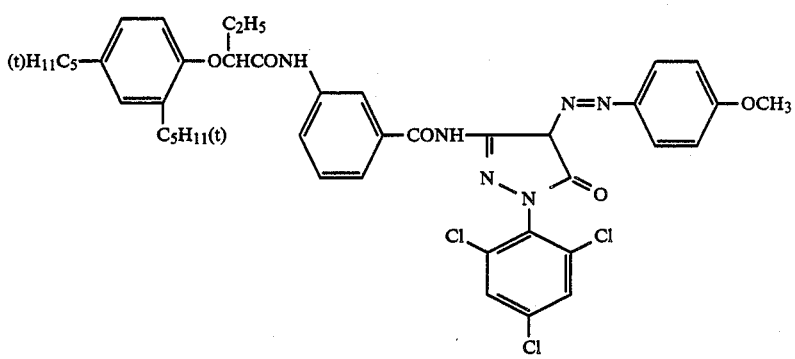

C-2

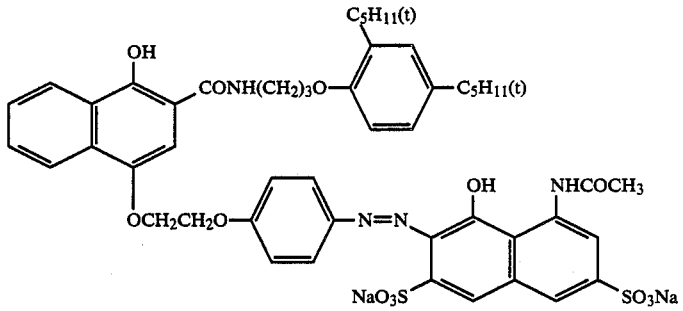

C-3

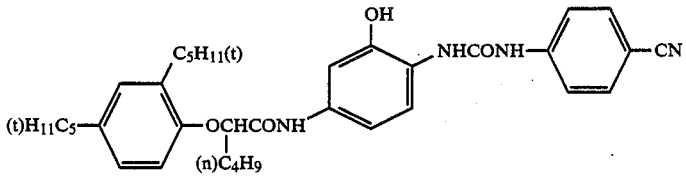

-continued
C-4
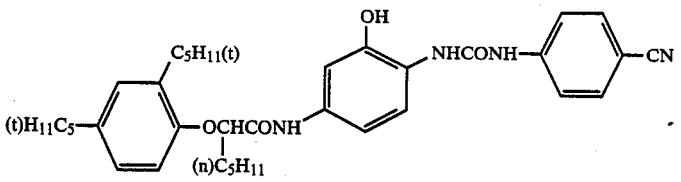
C-6
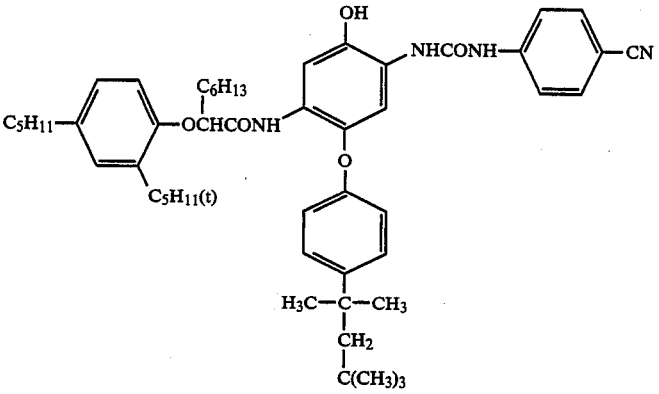
C-7
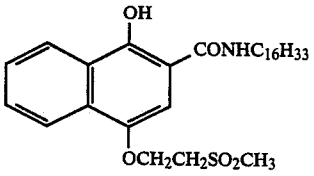
C-9
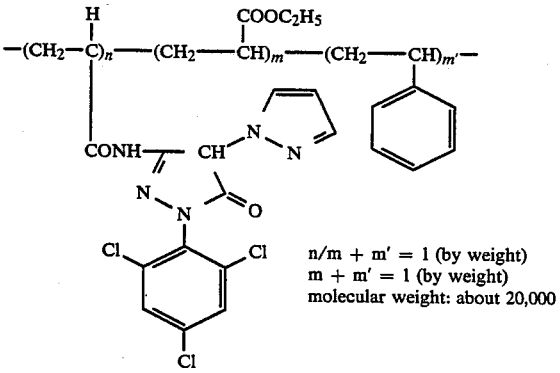
n/m + m' = 1 (by weight)
m + m' = 1 (by weight)
molecular weight: about 20,000
C-10
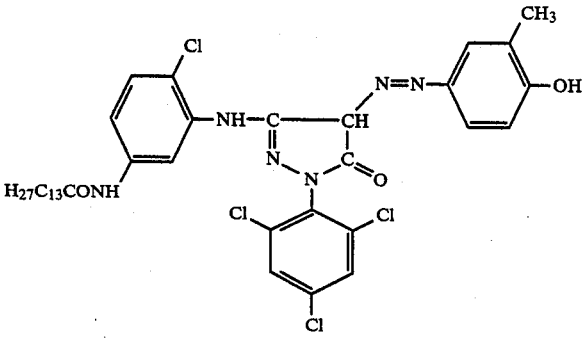

-continued
C-11
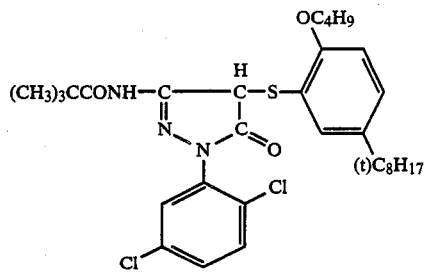
C-12
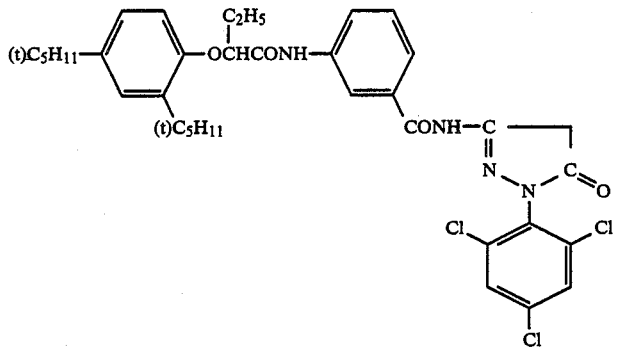
C-13
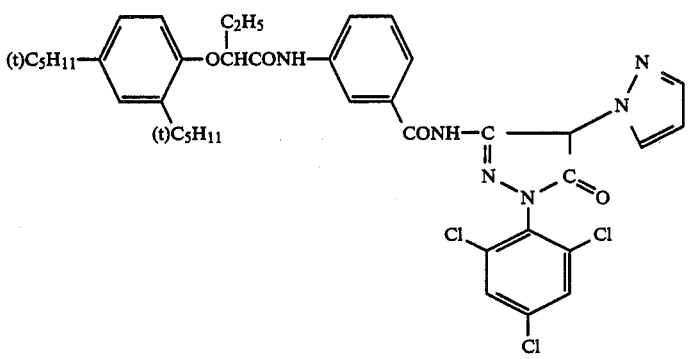
C-14
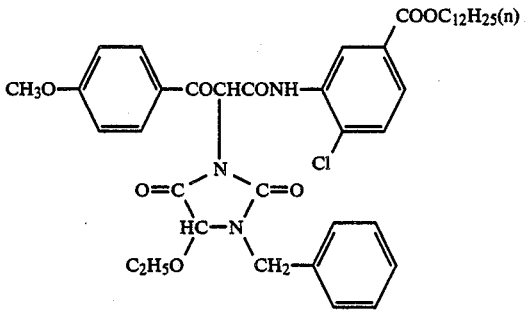
Cpd A
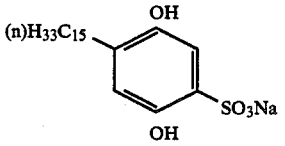
Cpd E
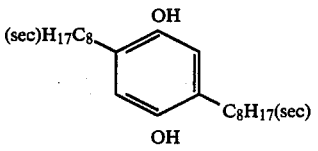

Sensitizing Dye I
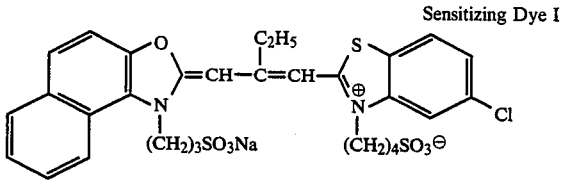
Sensitizing Dye II
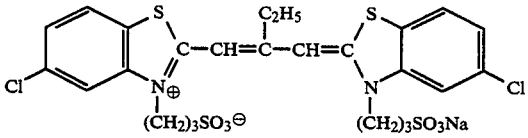
Sensitizing Dye III
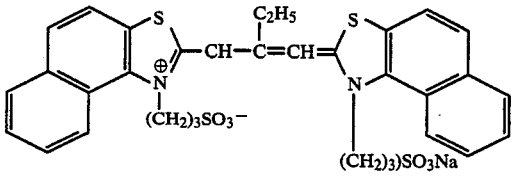
Sensitizing Dye IV
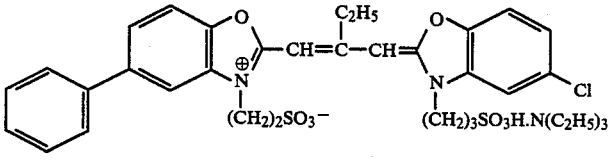
Sensitizing Dye V
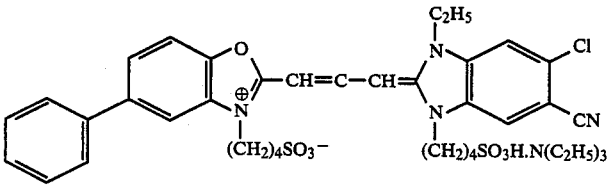
Sensitizing Dye VI
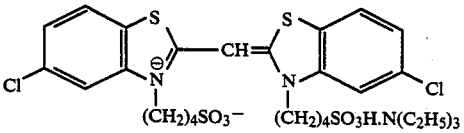
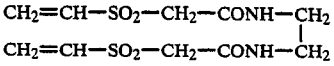
H-1
-continued
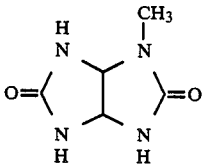
S-1
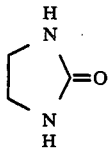
S-2
DIR Coupler A R = $NHCO(t)C_5H_{11}$
B R = Br
D R = $COOCH_2CH_2OC_2H_5$
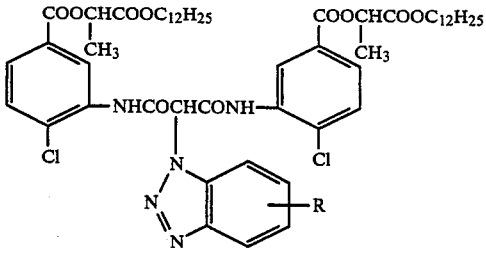
DIR Coupler C
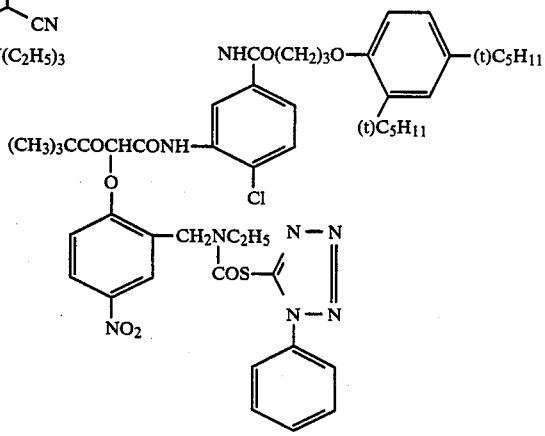

EXAMPLE 2

Multi-layer color light-sensitive materials, Samples 201 to 206, comprising the layers of the following formulation were prepared.

(Formulation of light-sensitive layer)

1st layer (Antihalation layer)
- Black colloidal silver: 0.4
- Gelatin: 1.3
- Colored coupler C-1: 0.06
  - UV ray absorbent UV-1: 0.1
  - UV ray absorbent UV-2: 0.2
  - Dispersing oil Oil-1: 0.01
  - Dispersing oil Oil-2: 0.01

2nd layer (Interlayer)
- Fine-grain silver bromide (mean grain size: 0.07μ): 0.15
- Gelatin: 1.0
- Colored coupler C-2: 0.02
- Dispersing oil Oil-1: 0.1

3rd layer (first red-sensitive emulsion layer)
- Silver bromoiodide emulsion (Silver iodide: 2 mol%; mean grain size: 0.3μ): 0.4
- Gelatin: 0.6
- Sensitizing Dye I: $1.0\times10^{-4}$
- Sensitizing Dye II: $3.0\times10^{-4}$
- Sensitizing Dye III: $1\times10^{-5}$
- Coupler C-3: 0.06
- Coupler C-4: 0.06
- Coupler C-8: 0.04
- Coupler C-2: 0.03
- Coupler C-5: 0.02
- Dispersing oil Oil-1: 0.03
- Dispersing oil Oil-3: 0.012

4th layer (Second red-sensitive emulsion layer)
- Silver bromoiodide emulsion (Silver iodide: 5 mol%; mean grain size: 0.5μ): 1.5
- Sensitizing Dye I: $1\times10^{-4}$
- Sensitizing Dye II: $3\times10^{-4}$
- Sensitizing Dye III: $1\times10^{-5}$
- Coupler C-3: 0.24
- Coupler C-4: 0.24
- Coupler C-8: 0.04
- Coupler C-2: 0.04
- Coupler C-5: 0.04
- Dispersing oil Oil-1: 0.15
- Dispersing oil Oil-3: 0.02

5th layer (Third red-sensitive emulsion layer)
- Silver bromoiodide emulsion (Silver iodide: 10 mol%; mean grain size: 0.7μ): 2.0
- Gelatin: 1.0
- Sensitizing Dye I: $1\times10^{-4}$
- Sensitizing Dye II: $3\times10^{-4}$
- Sensitizing Dye III: $1\times10^{-5}$
- Coupler C-6: 0.05
- Coupler C-7: 0.1
- Dispersing oil Oil-1: 0.01
- Dispersing oil Oil-2: 0.05

6th layer (Interlayer)
- Gelatin: 1.0
- Compound Cpd-A: 0.03
- Dispersing Oil-1: 0.05

7th layer (First green-sensitive emulsion layer)
- Silver bromoiodide emulsion (Silver iodide: 4 mol%; mean grain size: 0.3μ): 0.7
- Sensitizing Dye IV: $5\times10^{-4}$
- Sensitizing Dye VI: $0.3\times10^{-4}$
- Gelatin: 1.0
- Coupler C-9: 0.2
- Coupler C-10: 0.03
- Coupler C-1: 0.03
- Coupler C-15: 0.02
- Dispersing oil Oil-1: 0.5

8th layer (Second green-sensitive emulsion layer)
- Silver bromoiodide emulsion (Silver iodide: 5 mol%; mean grain size: 0.5μ): 1.4
- Sensitizing Dye VI: $5\times10^{-4}$
- Sensitizing Dye V: $2\times10^{-4}$
- Coupler C-9: 0.25
- Coupler C-1: 0.03
- Coupler C-10: 0.015
- Coupler C-15: 0.03
- Dispersing oil Oil-1: 0.2

9th layer (Third green-sensitive emulsion layer)
- Silver bromoiodide emulsion (Silver iodide: 6 mol%; mean grain size: 0.7μ): 1.9
- Gelatin: 1.0
- Sensitizing Dye IV: $3.5\times10^{-4}$
- Sensitizing Dye V: $1.4\times10^{-4}$
- Coupler C-11: 0.01
- Coupler C-12: 0.03
- Coupler C-13: 0.20
- Coupler C-1: 0.02
- Dispersing oil Oil-1: 0.20
- Dispersing oil Oil-2: 0.05

10th layer (Yellow filter layer)
- Gelatin: 1.2
- Yellow colloidal silver: 0.08
- Compound Cpd-B: 0.1
- Dispersing oil Oil-1: 0.3

11th layer (First blue-sensitive emulsion layer)
- Mono-dispersed silver bromoiodide emulsion (Silver iodide: 4 mol%; mean grain size: 0.3μ): 1.0
- Gelatin: 1.0
- Sensitizing Dye V: $2\times10^{-4}$
- Coupler C-14: 0.9
- Coupler C-16: 0.09
- Dispersing oil Oil-1: 0.2

12th layer (Second blue-sensitive emulsion layer)
- Silver bromoiodide emulsion (Silver iodide: 10 mol%; mean grain size: 1.5μ): 0.9
- Gelatin: 0.6
- Sensitizing Dye VI: $1\times10^{-4}$
- Coupler C-14: 0.25
- Dispersing oil Oil-1: 0.07

13th layer (First protective layer)
- Gelatin: 0.8
- UV ray absorbent UV-1: 0.1
- UV ray absorbent UV-2: 0.2
- Dispersing oil Oil-1: 0.01
- Dispersing oil Oil-2: 0.01

14th layer (Second protective layer)
- Fine-grain silver bromide (mean grain size: 0.07μ): 0.5
- Gelatin: 0.45
- Polymethyl methacrylate particles (diameter: 1.5μ): 0.2
- Hardener H-1: 0.4
- Formaldehyde scavenger S-1: 0.5
- Formaldehyde scavenger S-2: 0.5

In addition to the above-described ingredients, a surfactant was added as a coating aid to each layer described above. The thus prepared sample was referred to as sample 201.

Chemical structures or chemical names of the compounds used in the present invention are shown below.

C-8

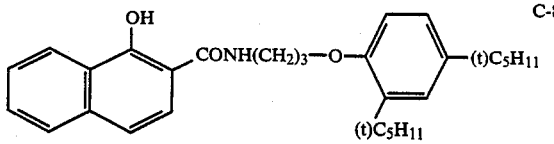

C-5

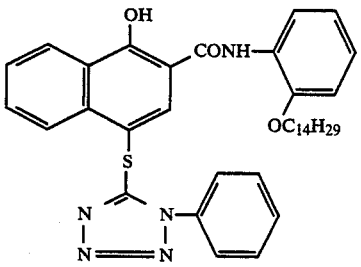

C-15

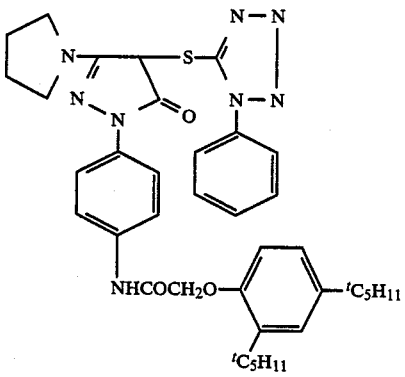

C-16

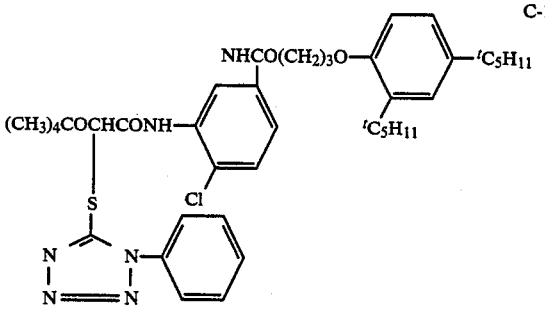

Preparation of samples 202 to 206:

With samples 202 and 205, DIR coupler (2) was added in an equal amount in place of DIR couplers C-5, C-15, and C-16 and, with samples 203 and 206, DIR coupler (37) was used in an equal amount. Further, silver removal accelerator (1) was added to samples 204 to 206 in an amount of $1.0\times10^{-3}$ mol/m$^2$.

These samples 201 to 206 were subjected to the following processing wherein bleaching time was shortened to 2 minutes. Processed samples were subjected to an analysis of silver amount using fluorescent X-rays to determine the amount of residual silver.

Results thus obtained are shown in Table 2.

Additionally, the amount of replenishing developer was 800 cc/m$^2$.

| | | |
|---|---|---|
| Color development | 3'15" | 38° C. |
| Bleaching | 2'00" | " |
| Washing with water | 2'10" | " |
| Fixing | 4'20" | " |
| Washing with water | 3'15" | " |
| Stabilizing | 1'05" | " |

Formulations of the processing solutions used in respective steps are as follows.

Color developer
- Diethylenetriaminepentaacetic acid: 1.0 g
- 1-Hydroxyethylidene-1,1-diphosphonic acid: 2.0 g
- Sodium sulfite: 4.0 g
- Potassium carbonate: 30.0 g
- Potassium bromide: 1.4 g
- Potassium iodide: 1.3 mg
- Hydroxylamine sulfate: 2.4 g
- 4-N-Ethyl-N-β-hydroxyethylamino)-2-methylaniline sulfate: 4.5 g
- Water to make: 1 liter
- pH: 10.0

Bleaching solution
- Ferric ammonium ethylenediaminetetraacetate: 100.0 g
- Disodium ethylenediaminetetraacetate: 10.0 g
- Ammonium bromide: 150.0 g
- Ammonium nitrate: 10.0 g
- Aqueous ammonia (28%): 7.0 ml
- Water to make: 1.0 liter
- pH: 6.0

Fixing solution
- Disodium ethylenediaminetetraacetate: 1.0 g
- Sodium sulfite: 4.0 g
- Ammonium thiosulfate aqueous solution (70%): 175.0 ml
- Sodium bisulfite: 4.6 g
- Water to make: 1.0 liter
- pH: 6.6

Stabilizing solution
- Formalin (40%): 2.0 ml
- Polyoxyethylene-p-monononylphenyl ether (mean polymerization degree: about 10): 0.3 g
- Water to make: 1.0 liter

TABLE 2

| Sample No. | DIR Coupler | Bleaching Accelerator | Amount of Residual Ag (μg/cm$^2$) |
|---|---|---|---|
| 201 (*) | C-5, C-15, C-16 | — | 20 |
| 202 (*) | (2) | — | 15 |
| 203 (*) | (37) | — | 16 |
| 204 (*) | C-5, C-15, C-16 | (1) | 12 |
| 205 (**) | (2) | (1) | 5 |
| 206 (**) | (37) | (1) | 7 |

(*) comparative example
(**) example of the present invention
Exposure conditions: 4,800° K., 25 CMS The above results show that combination of the present invention can minimize the amount of residual silver and shorten the bleaching time.

EXAMPLE 3

In order to examine the effect of bleaching accelerators added to a bleaching solution, the same exposure and processing as in Example 2 were conducted using samples used in Example 2 and bleaching solutions containing bleaching accelerators shown in Table 3 in an amount of 0.5 mol/liter.

Results thus obtained are shown in Table 3.

TABLE 3

| Sample No. | Bleaching Accelerator | Amount of Residual Silver ($\mu g/cm^2$) |
|---|---|---|
| 201 (*) | — | 20 |
| 202 (*) | — | 15 |
| 201 (*) | (1) | 14 |
| 202 (**) | (1) | 7 |
| 201 (*) | (6) | 12 |
| 202 (**) | (6) | 6 |

(*) comparative example;
(**) example of the present invention.

Combination of the DIR coupler of the present invention and a bleaching accelerator minimizes the amount of residual silver and can be put into practice even when bleaching time is shortened.

EXAMPLE 4

The same processings as in Example 2 were conducted using samples in Example 2 and bleaching solutions having a reduced pH to obtain results shown in Table 4. pH of the bleaching solution was adjusted by reducing the amount of aqueous ammonia (28%).

TABLE 4

| Sample No. | pH of Bleaching Solution | Amount of Residual Silver ($\mu g/cm^2$) |
|---|---|---|
| 201 (*) | 5.5 | 13 |
| 202 (**) | " | 6 |
| 203 (**) | " | 7 |
| 204 (*) | " | 8 |
| 205 (**) | " | 1 |
| 206 (**) | " | 2 |

(*) comparative example;
(**) example of the present invention

With every sample, the amount of residual silver was reduced by decreasing the pH of the bleaching solution. This is particularly remarkable when a DIR coupler of the present invention was used. Further, the best effects were obtained by combining with the bleaching accelerator of the present invention.

EXAMPLE 5

Samples of Example 2 were subjected to the processing using a bleach-fixing bath of the following formulation to examine the amount of residual silver in the same manner.

Results are shown in Table 5.

| | | |
|---|---|---|
| Color development | 3'15" | 38° C. |
| Bleaching | 2'00" | " |
| Rinsing | 1'40" | " |
| Stabilizing | 40" | " |

Color developer
- Diethylenetriaminepentaacetic acid: 1.0 g
- 1-Hydroxyethylidene-1,1-diphosphonic acid: 2.0 g
- Sodium sulfite: 4.0 g
- Potassium carbonate: 30.0 g
- Potassium bromide: 1.4 g
- Potassium iodide: 1.3 mg
- Hydroxylamine sulfate: 2.4 g
- 4-(N-Ethyl-N-β-hydroxyethylamino)-2-methylaniline sulfate: 4.5 g
- Water to make: 1 liter
- pH: 10.0

Bleaching-fixing Solution
- Ferric ammonium ethylenediaminetetraacetate: 80.0 g
- Disodium ethylenediaminetetraacetate: 10.0 g
- Sodium sulfite: 12.0 g
- Ammonium thiosulfate aqueous solution (70%): 240 ml
- Water to make: 1.0 liter
- pH: adjusted to 6.8 with aqueous ammonia (28%)

Rinsing solution
- Disodium ethylenediaminetetraacetate: 0.4 g
- Water to make: 1.0 liter
- pH: adjusted to 7.0 with sodium hydroxide Stabilizing solution
- Formalin (37% w/v): 2.0 ml
- Polyoxyethylene-p-monononylphenyl ether (mean polymerization degree: about 10): 0.3 g
- Water to make: 1.0 liter

TABLE 5

| Sample No. | Amount of Residual Silver ($\mu g/cm^2$) |
|---|---|
| 201 (*) | 27 |
| 202 (*) | 22 |
| 203 (*) | 23 |
| 204 (*) | 18 |
| 205 (**) | 9 |
| 206 (**) | 8 |

(*) comparative example
(**) example of the present invention

As is clear from Table 5, in conducting bleach-fixing, combination of the present invention minimizes the amount of residual silver, thus being found to be excellent.

EXAMPLE 6

Samples of Example 2 were subjected to the following processing wherein the silver-removing step was changed to a bleaching bath and a subsequent bleach-fixing. Results thus obtained are shown in Table 6.

| | | |
|---|---|---|
| Color development | 3'15" | 38° C. |
| Bleaching | 30" | " |
| Bleach-fixing | 1'30" | " |
| Rinsing | 1'40" | " |
| Stabilizing | 40" | " |

Formulations of the processing solutions used in respective steps are shown below.

Color developer
- Diethylenetriaminepentaacetic acid: 1.0 g
- 1-Hydroxyethylidene-1,1-diphosphonic acid: 2.0 g
- Sodium sulfite: 4.0 g
- Potassium carbonate: 30.0 g
- Potassium bromide: 1.4 g
- Potassium iodide: 1.3 mg
- Hydroxylamine sulfate: 2.4 g
- 4-(N-Ethyl-N-β-hydroxyethylamino)-2-methylaniline sulfate: 4.5 g
- Water to make: 1 liter
- pH: 10.0

Bleaching Solution
- Ammonium bromide: 100 g
- Ferric ammonium ethylenediaminetetraacetate: 120 g
- Disodium ethylenediaminetetraacetate: 10.0 g
- Ammonium nitrate: 10.0 g
- Aqueous ammonia: 17.0 ml
- Water to make: 1.0 liter pH: 6.5

Bleach-fixing solution

Ammonium bromide: 50.0 g

Ferric ammonium ethylenediaminetetraacetate: 50.0 g

Disodium ethylenediaminetetraacetate: 5.0 g

Ammonium nitrate: 5.0 g

Sodium sulfite: 12.0 g

Ammonium thiosulfate aqueous solution (70%): 240 ml

Aqueous ammonia: 10.0 ml

Water to make: 1.0 liter pH: 7.3

Rinsing solution

Disodium ethylenediaminetetraacetate: 0.4 g

Water to make: 1.0 liter pH: adjusted to 7.0 with NaOH

Stabilizing solution

Formalin (40%): 2.0 ml

Polyoxyethylene-p-monononylphenyl ether (mean polymerization degree: about 10): 0.3 g Water to make: 1.0 liter

TABLE 6

| Sample No. | Amount of Residual Silver ($\mu g/cm^2$) |
|---|---|
| 201 (*) | 23 |
| 202 (*) | 19 |
| 203 (*) | 20 |
| 204 (*) | 15 |
| 205 (**) | 6 |
| 206 (**) | 7 |

(*) comparative example
(**) example of the present invention

As is clear from Table 6, in the case of conducting the processing in the steps of a bleaching bath and a bleach-fixing bath, only the combination of the present invention can minimize the amount of residual silver.

EXAMPLE 7

Samples of Example 2 were subjected to the processing using a bleaching bath of the following formulation. Results are shown in Table 7.

| | | |
|---|---|---|
| Color development | 3'15" | 38° C. |
| Bleaching | 2'00" | " |
| Fixing | 3'15" | " |
| Stabilizing | 1'30" | " |

The stabilizing bath was divided into 3 tanks and processing time in each tank was 1 minute 30 seconds.

Formulations of the processing solutions used in respective steps are as follows.

Color developer

Same as in Example 2.

Bleaching solution

Ferric ammonium trimethylenediaminetetraacetate: 60.0 g

Ferric ammonium ethylenediaminetetraacetate: 50.0 g

Disodium ethylenediaminetetraacetate: 10.0 g

Ammonium bromide: 150.0 g

Ammonium nitrate: 10.0 g

Aqueous ammonia (28%): 4.0 ml

Water to make: 1.0 liter pH: 6.0

Fixing solution

Same as in Example 2.

Stabilizing solution

Formalin (40%): 2.0 ml

Polyoxyethylene-p-monononylphenyl ether (mean polymerization degree: about 10): 0.3 g 5-Chloro-2-methyl-4-isothiazolin-3-one: 0.01 g Disodium ethylenediaminetetraacetate: 0.3 g Water to make: 1.0 liter

TABLE 7

| Sample No. | Amount of Residual Silver ($\mu g/cm^2$) |
|---|---|
| 201 (*) | 16 |
| 202 (*) | 12 |
| 203 (*) | 13 |
| 204 (*) | 13 |
| 205 (**) | 5 |
| 206 (**) | 4 |

(*) comparative example
(**) example of the present invention

While the invention has been described in detail and with reference to specific embodiments thereof, it will be apparent to one skilled in the art that various changes and modifications can be made therein without departing from the spirit and scope thereof.

What is claimed is:

1. A process for processing a DIR coupler-containing silver halide color photographic material for photographing use in a continuous manner with replenishment of a developing solution, in which said DIR coupler is a coupler which has in a coupling active site a group that functions as a development inhibitor or a development inhibitor precursor upon being eliminated from the coupling active site by color development processing and that will be decomposed to a compound exerting substantially no influences on photographic properties after flowing into a color developing solution, said development inhibitor having a half-value period of 4 hours or shorter at a pH of 10.0, and in which process the developing solution is replenished in an amount of 700 ml or less per $m^2$ of light-sensitive material developed; wherein the DIR coupler is represented by the following general formula (I'):

$$A[(L_1)_a—Z—(L_2—Y)_b—]_m \quad (I')$$

wherein:

A represents a coupler component;

Z represents a fundamental portion of a compound which shows development-inhibiting action, and is bound to the coupling site of a coupler directly (a=0) or through a linking group, $L_1$ (a=1);

Y represents a substituent bond to Z through a linking group $L_2$ to allow the development-inhibiting effect of Z to emerge, with the linking group represented by $L_2$ containing a chemical bond to be cleaved in a developer;

a represents 0 or 1, and b represents 1 or 2, provided that when b represents 2, two (—$L_2$Y)s may be the same or different; and m represents 1 or 2.

2. A process for processing a DIR coupler-containing silver halide color photographic material for photographing use in a continuous manner with replenishment of a developing solution, in which said DIR coupler is a coupler which in a coupling active site a group that functions as a development inhibitor or a precursor thereof upon being eliminated from the coupling active site by color development processing and that will be decomposed to a compound exerting substantially no influences on photographic properties after flowing into a color developing solution, said development inhibitor having a half-value period of 4 hours or shorter at a pH of 10.0, and which process is conducted in the presence of a compound or compounds represented by the following general formula (I) and/or (II):

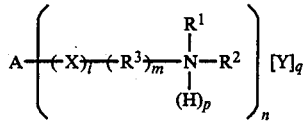

(I)

wherein:

A represents an n-valent aliphatic, aromatic or heterocyclic linking group (provided that, when n=1, A represents a mere aliphatic, aromatic or heterocyclic group);

$X_1$ represents

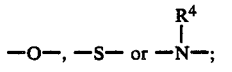

$R^1$ and $R^2$ each represents a substituted or unsubstituted lower alkyl group;

$R^3$ represents a lower alkylene group containing 1 to 5 carbon atoms;

$R^4$ represents a lower alkyl group; or $R^1$ and $R^2$, $R^1$ and A, $R^1$ and $R^3$, $R^2$ and A, or $R^2$ and $R^3$ may be connected to each other to form a ring;

Y represents an anion;

l represents 0 or 1;

m represents 0 or 1;

n represents 1, 2 or 3;

p represents 0 or 1; and q represents 0, 1, 2 or 3;

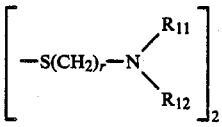

(II)

wherein:

r represents an integer of 1 to 3:

$R_{11}$ and $R_{12}$ each represents a hydrogen atom, a lower alkyl group containing 1 to 5 carbon atoms, or an acyl group containing 1 to 3 carbon atoms (provided that $R_{11}$ and $R_{12}$ do not represent a hydrogen atom at the same time); or $R_{11}$ and $R_{12}$ may be taken together to form a ring;

and wherein the DIR coupler is represented by the following general formula (I'):

$$A[(L_1)_a—Z—(L_2—Y)_b—]_m \quad (I')$$

wherein:

A represents a coupler component;

Z represents a fundamental portion of a compound which shows development-inhibiting action, and is bound to the coupling site of a coupler directly (a=0) or through a linking group, $L_1$ (a=1);

Y represents a substituent bound to Z through a linking group $L_2$ to allow the development-inhibiting effect of Z to emerge, with the linking group represented by $L_2$ containing a chemical bond to be cleaved in a developer;

a represents 0 or 1, and b represents 1 or 2, provided that when b represents 2, two (—$L_2$Y)s may be the same or different; and m represents 1 or 2.

3. A process for processing a DIR coupler-containing silver halide color photographic material for photographing use in a continuous manner with replenishment of a developing solution, in which said DIR coupler is a coupler which has in a coupling active site a group that functions as a development inhibitor or a precursor thereof upon being eliminated from the coupling active site by color development processing and that will be decomposed to a compound exerting substantially no influences on photographic properties after flowing into a color developing solution, said development inhibitor having a half-value period of 4 hours or shorter at a pH of 10.0, and in which process the light-sensitive material is processed, after the color development, in a bleaching solution having a pH of 5.7 or less; and wherein the DIR coupler is represented by the following general formula (I'):

$$A[(L_1)_a—Z—(L_2—Y)_b—]_m \quad (I')$$

wherein:

A represents a coupler component;

Z represents a fundamental portion of a compound which shows development-inhibiting action, and is bound to the coupling site of a coupler directly (a=0) or through a linking group, $L_1$ (a=1);

Y represents a substituent bound to Z through a linking group $L_2$ to allow the development-inhibiting effect of Z to emerge, with the linking group represented by $L_2$ containing a chemical bond to be cleaved in a developer;

a represents 0 or 1, and b represents 1 or 2, provided that when b represents 2, two (—$L_2$Y)s may be the same or different; and m represents 1 or 2.

4. The process for processing a silver halide photographic material as described in claim 2, wherein the photographic material is processed, in a silver-removing step, in a bath having a bleach-fixing ability or in a bleaching bath and a subsequent bath having a bleach-fixing ability.

5. The process for processing a silver halide photographic material as described in claim 2, wherein a bleaching bath having a pH of 5.7 or less is provided in a silver-removing step.

6. The process for processing a silver halide photographic material as described in claim 1, which is conducted in the presence of at least one of the compounds represented by the general formula (I) and/or (II):

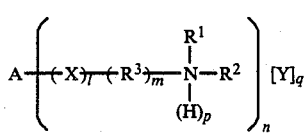

(I)

wherein:

A represents an n-valent aliphatic, aromatic or heterocyclic linking group (provided that, when n=1, A represents a mere aliphatic, aromatic or heterocyclic group);

X represents $$-O-,\ -S-\ \text{or}\ -\overset{R^4}{\overset{|}{N}}-;$$

$R^1$ and $R^2$ each represents a substituted or unsubstituted lower alkyl group;

$R^3$ represents a lower alkylene group containing 1 to 5 carbon atoms;

$R^4$ represents a lower alkyl group; or $R^1$ and $R^2$, $R^1$ and A, $R^1$ and $R^3$, $R^2$ and A, or $R^2$ and $R^3$ may be connected to each other to form a ring;

Y represents an anion;

l represents 0 or 1;

m represents 0 or 1;

n represents 1, 2 or 3;

p represents 0 or 1; and q represents 0, 1, 2 or 3, (II)

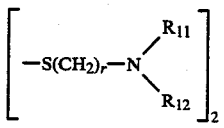

wherein:

r represents an integer of 1 to 3;

$R_{11}$ and $R_{12}$ each represents a hydrogen atom, a lower alkyl group containing 1 to 5 carbon atoms, or an acyl group containing 1 to 3 carbon atoms (provided that $R_{11}$ and $R_{12}$ do not represent a hydrogen atom at the same time); or $R_{11}$ and $R_{12}$ may be taken together to form a ring.

7. The process for processing a silver halide photographic material as described in claim 6, wherein the photographic material is processed, in the silver-removing step, in a bath having a bleach-fixing ability or in a bleaching bath and a subsequent bath having a bleach-fixing ability.

8. The process for processing a silver halide photographic material as described in claim 7, wherein said bleaching solution has a pH of 5.7 or less.

9. A process as in claims 1, 2, or 3 wherein Z in formula (I') represents a divalent N-containing heterocyclic group or a N-containing heterocyclic thiogroup.

10. A process as in claims 1, 2, or 3 wherein Z in formula (I') represents a thiogroup selected from the group consisting of tetraazylthio group, a benzylthiozylthio group, benzimidazolylthio group, a triazolylthiolyl group, and an imidazoylythio group.

11. The process as in claims 1, 2 or 3 wherein the DIR coupler is represented by the following general formula (II'), (III'), (IV'), (V'), (VI'), (VII'), (VIII'), (IX'), (X'), (XI'), (XII'):

(II')

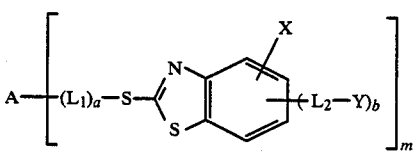

-continued (III')

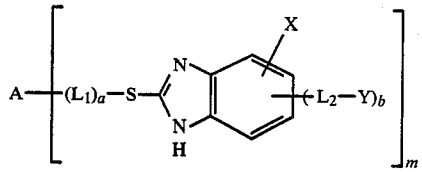

(IV')

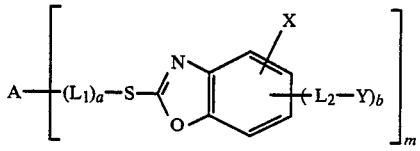

(V')

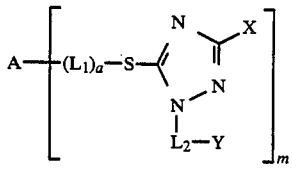

(VI')

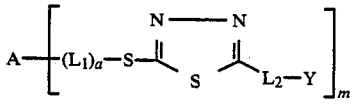

(VII')

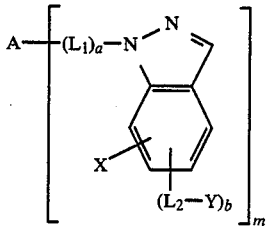

(VIII')

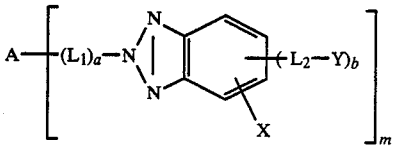

(IX')

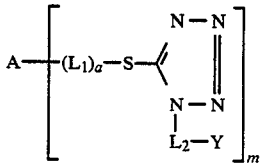

(X')

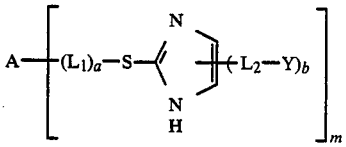

(XI')

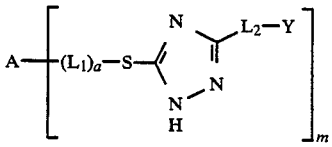

-continued (XII')

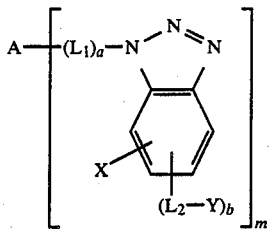

wherein:

A represents a coupler component;

Y represents a substituent bound to a fundamental portion of a compound which shows development-inhibiting action through a linking group $L_2$ to allow the development-inhibiting effect of a compound which shows development-inhibiting action to emerge, with the linking group represented by $L_2$ containing a chemical bond to be cleaved in a developer;

a represents 0 or 1, and b represents 1 or 2, provided that when b represents 2, two $(-L_2Y)$s may be the same or different; and m represents 1 or 2.

12. A process as in claim 1, wherein said half-value period is not longer than 2 hours.

13. A process as in claim 1, wherein said half-value period is not longer than 1 hours.

14. A process as in claim 1, wherein said $L_2$ in the general formula (I') is selected from the following groups together with the substitution positions of Z and Y:

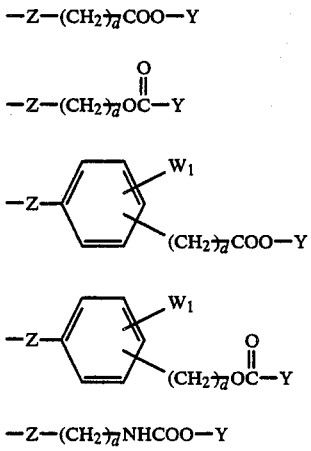

-continued

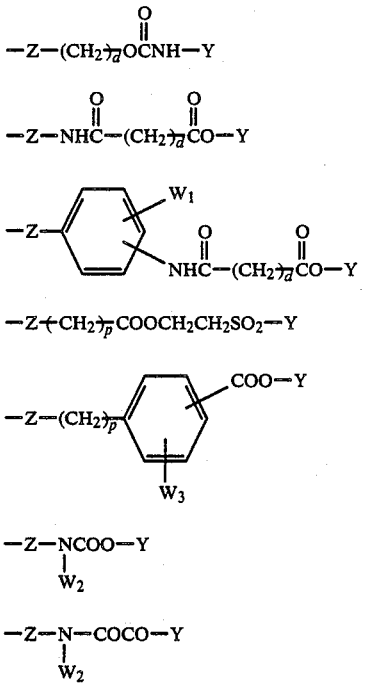

wherein d represents an integer of 0 to 10, $W_1$ is a hydrogen atom, a halogen atom, an alkyl group containing 1 to 10 carbon atoms, an alkanamido group containing 1 to 10 carbon atoms, an alkoxycarbonyl group containing 2 to 10 carbon atoms, an aryloxycarbonyl group, an alkanesulfonamido group containing 7 to 10 carbon atoms, an aryl group containing 6 to 10 carbon atoms, a carbamoyl group, an N-alkylcarbamoyl group containing 1 to 10 carbon atoms, a nitro group, a cyano group, an arylsulfonamido group containing 6 to 10 carbon atoms, a sulfamoyl group, or an imido group, $W_2$ represents a hydrogen atom, an alkyl group containing 1 to 6 carbon atoms, an aryl group containing 6 to 10 carbon atoms, or an alkenyl group containing 2 to 10 carbon atoms, $W_3$ represents a hydrogen atom, a halogen atom, a nitro group, an alkoxy group containing 1 to 6 carbon atoms, or an alkyl group containing 1 to 6 carbon atoms, and P represents an integer of 0 to 6.

15. A process as in claim 1, wherein the amount of the developing solution to be replenished is not more than 600 ml per $m^2$ of the light-sensitive material developed.

16. A process as in claim 1, wherein the amount of the developing solution to be replenished is not more than 500 ml per $m^2$ of the light-sensitive material developed.

* * * * *